US006230440B1

(12) United States Patent
Deutsch

(10) Patent No.: US 6,230,440 B1
(45) Date of Patent: May 15, 2001

(54) ROTATING DISPLAY DEVICE

(76) Inventor: Richard Deutsch, 8 Bayview Ave., Islip, NY (US) 11751

( * ) Notice: Subject to any disclaimer, the term of this patent is extended or adjusted under 35 U.S.C. 154(b) by 0 days.

(21) Appl. No.: 09/009,018

(22) Filed: Jan. 20, 1998

(51) Int. Cl.[7] ..... A47G 7/02
(52) U.S. Cl. ..... 47/67
(58) Field of Search ..... 47/28.1, 26, 29, 47/30

(56) References Cited

U.S. PATENT DOCUMENTS

| | | | |
|---|---|---|---|
| D. 243,808 | 3/1977 | Helm | D6/4 |
| D. 244,013 | 4/1977 | Perkins | D11/2 |
| D. 258,206 | 2/1981 | Bourke | D11/156 |
| 3,882,634 | 5/1975 | Dedolph | 47/1.2 |
| 3,909,978 | 10/1975 | Fleming | 47/1.2 |
| 3,930,334 | 1/1976 | Johnston | 47/35 |
| 3,932,958 | 1/1976 | Kistler, Jr. et al. | 47/26 |
| 3,950,637 | 4/1976 | Rodin | 240/10 P |
| 3,973,353 | 8/1976 | Dedolph | 47/1.2 |
| 3,990,179 | 11/1976 | Johnson et al. | 47/35 |
| 3,998,007 | 12/1976 | Martin | 47/39 |
| 4,001,959 | 1/1977 | Grendahl | 40/152.1 |
| 4,005,843 | 2/1977 | Wengel | 248/220.2 |
| 4,026,067 | 5/1977 | Wengel | 47/39 |
| 4,026,220 | 5/1977 | Schuring, Jr. | 108/101 |
| 4,051,627 | 10/1977 | Schilling, Jr. | 47/39 |
| 4,059,920 | 11/1977 | Worrell | 47/67 |
| 4,068,405 | 1/1978 | Campbell et al. | 47/65 |
| 4,068,761 | 1/1978 | McCarthy | 211/134 |
| 4,097,015 | 6/1978 | Frishman | 248/339 |
| 4,101,036 | 7/1978 | Craig | 211/86 |
| 4,102,081 | 7/1978 | Marrow | 47/67 |
| 4,109,415 | 8/1978 | Hall | 47/67 |
| 4,117,627 | 10/1978 | Slingerland, Jr. | 47/39 |
| 4,117,630 | 10/1978 | Kalas | 47/67 |
| 4,149,339 | 4/1979 | Hall et al. | 47/67 |
| 4,159,094 | 6/1979 | Stekoll et al. | 248/318 |
| 4,167,908 | 9/1979 | Jones et al. | 108/111 |
| 4,170,843 | 10/1979 | Talwani | 47/39 |
| 4,175,354 | 11/1979 | Anderson | 47/39 |
| 4,187,996 | 2/1980 | Ehrilch | 242/107.4 R |
| 4,188,891 | 2/1980 | Boyajian | 108/42 |
| 4,189,124 | 2/1980 | Faris | 248/318 |
| 4,216,619 | 8/1980 | Espy | 47/67 |
| 4,220,306 | 9/1980 | Cueto et al. | 248/328 |
| 4,227,343 | 10/1980 | Espy et al. | 47/39 |
| 4,306,280 | 12/1981 | Burke | 362/396 |

(List continued on next page.)

*Primary Examiner*—Charles T. Jordan
*Assistant Examiner*—Francis T. Palo
(74) *Attorney, Agent, or Firm*—Richard L. Miller, P.L

(57) ABSTRACT

A rotatable display device that is suspendable from a ceiling and allows a planter to be rotatably suspendable therefrom. The device includes a lower housing. An upper housing is replaceably attached to the lower housing. A top hanger assembly extends upwardly from the upper housing and suspends the rotatable display device from the ceiling while providing a means for grabbing the upper housing when the upper housing is to be removed from the lower housing. A rotatable plate is contained in, and rotatable relative to, one of the lower housing and the upper housing. A bearing assembly rotatably connects the rotatable plate to the other of the one of the lower housing and the upper housing. A driven gear is fixedly attached to, for rotation with, the rotatable plate. A bottom hanger assembly extends downwardly from, and rotates with, one of the rotatable plate and the driven gear for rotatably suspending the planter therefrom. A motor is contained in the other of the one of the lower housing and the upper housing for rotating the rotatable plate. A motor shaft extends from the motor. A driver gear is fixedly attached to the motor shaft for rotation therewith and is contained in the lower housing, and is rotatably operatively connected to, the driven gear.

39 Claims, 4 Drawing Sheets

U.S. PATENT DOCUMENTS

| | | | |
|---|---|---|---|
| 4,314,646 | 2/1982 | Purnell | 211/113 |
| 4,323,215 | 4/1982 | Berger | 248/544 |
| 4,373,695 | 2/1983 | Faris | 248/318 |
| 4,385,742 | 5/1983 | Rocquin | 248/318 |
| 4,389,813 | 6/1983 | Jaques et al. | 47/67 |
| 4,446,653 | 5/1984 | Morgan, Jr. | 47/67 |
| 4,449,324 | 5/1984 | Ostarly | 47/67 |
| 4,543,744 | 10/1985 | Royster | 47/17 |
| 4,556,184 | 12/1985 | O'Sullivan | 248/330.1 |
| 4,574,521 | 3/1986 | Landy | 47/67 |
| 4,583,323 | 4/1986 | Graves et al. | 47/67 |
| 4,592,166 | 6/1986 | Tendrup et al. | 47/67 |
| 4,601,453 | 7/1986 | Kagan | 248/329 |
| 4,622,776 | 11/1986 | Pfaff | 47/67 |
| 4,622,777 | 11/1986 | Greene, Jr. | 47/67 |
| 4,658,540 | 4/1987 | Hougard | 47/67 |
| 4,666,115 | 5/1987 | Schiro | 248/225.1 |
| 4,691,473 | 9/1987 | Ragen | 47/67 |
| 4,825,589 | 5/1989 | Straw et al. | 47/67 |
| 4,837,972 | 6/1989 | Reed | 47/67 |
| 4,873,790 | 10/1989 | Laterza | 47/67 |
| 4,887,785 | 12/1989 | Blaich | 248/339 |
| 4,896,455 | 1/1990 | Kuban | 47/66 |
| 4,899,489 | 2/1990 | Shishkin | 47/65 |
| 4,908,982 | 3/1990 | Quantrini | 47/39 |
| 4,969,290 | 11/1990 | Skoretz | 47/39 |
| 4,991,344 | 2/1991 | Carney | 47/39 |
| 5,028,026 | 7/1991 | Philipps et al. | 248/206.2 |
| 5,037,049 | 8/1991 | Funk | 248/165 |
| 5,052,148 | 10/1991 | Sharon et al. | 47/67 |
| 5,065,971 | 11/1991 | Gaube | 248/330.1 |
| 5,077,936 | 1/1992 | Beaven | 47/67 |
| 5,152,099 | 10/1992 | Nilssen | 47/65 |
| 5,219,141 | 6/1993 | Pecor | 248/328 |
| 5,224,293 | 7/1993 | Sarb | 47/66 |
| 5,241,781 | 9/1993 | Malczyk | 47/17 |
| 5,269,488 | 12/1993 | Lach | 248/535 |
| 5,315,784 | 5/1994 | Henehan | 47/67 |
| 5,329,728 | 7/1994 | Ray | 47/67 |
| 5,333,409 | 8/1994 | Mendes | 47/67 |
| 5,337,986 | 8/1994 | Vollink | 248/218.4 |
| 5,360,193 | 11/1994 | Cobb | 248/318 |
| 5,390,443 | 2/1995 | Emalfarb et al. | 47/67 |
| 5,430,972 | 7/1995 | Wianecki | 47/66 |
| 5,454,187 | 10/1995 | Wasserman | 47/39 |
| 5,478,039 | 12/1995 | Wright | 248/341 |
| 5,546,698 * | 8/1996 | Rock | 47/67 |
| 6,128,854 * | 10/2000 | Chaney | 47/39 |

* cited by examiner

FIG.1
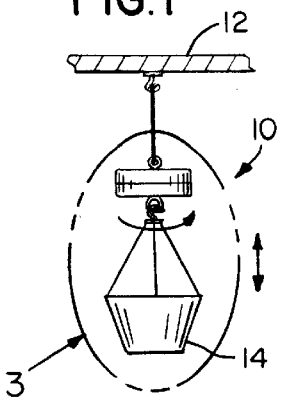
FIG.2
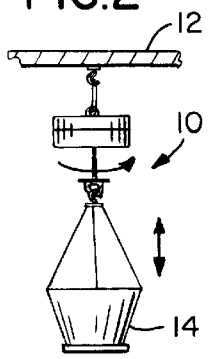
FIG.13
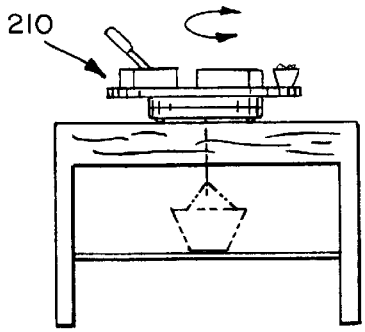
FIG.10
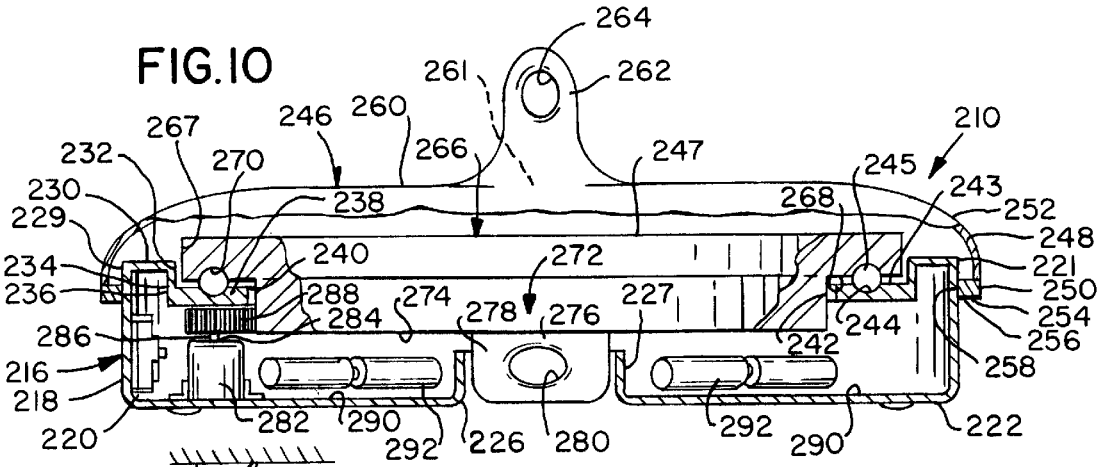
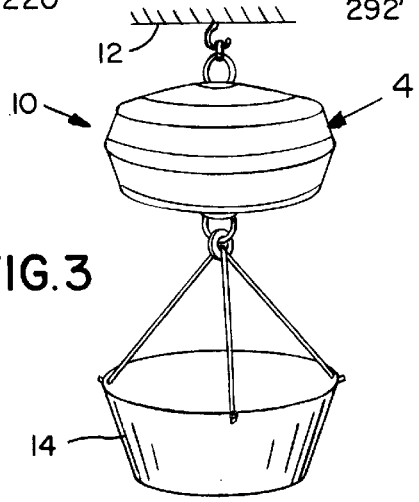
FIG.3
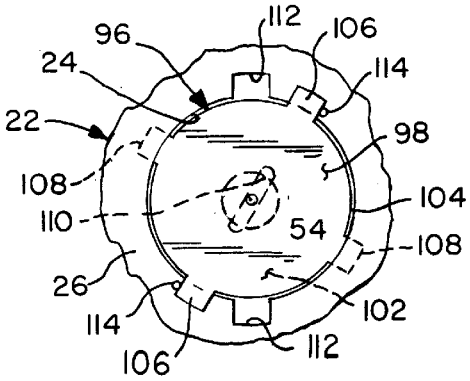
FIG.9

FIG.4
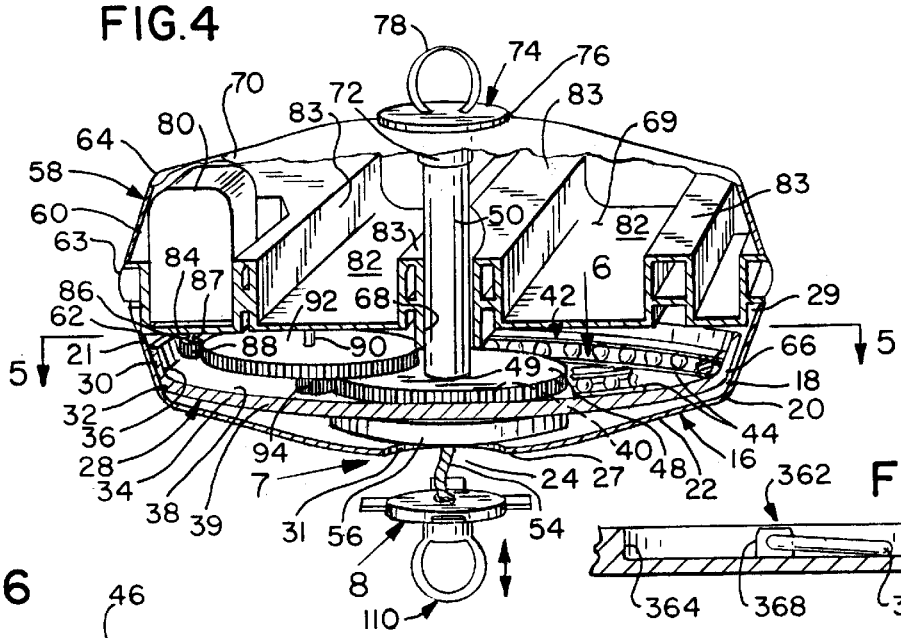
FIG.12
FIG.6
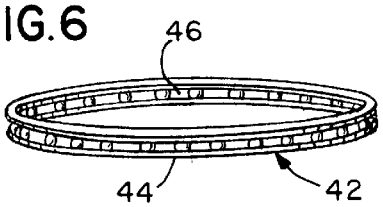
FIG.11
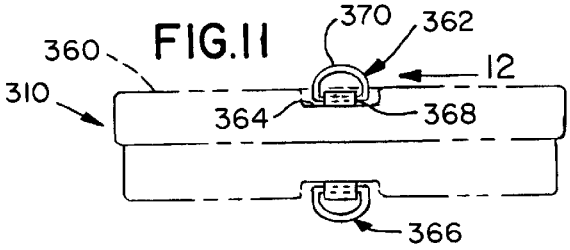
FIG.5
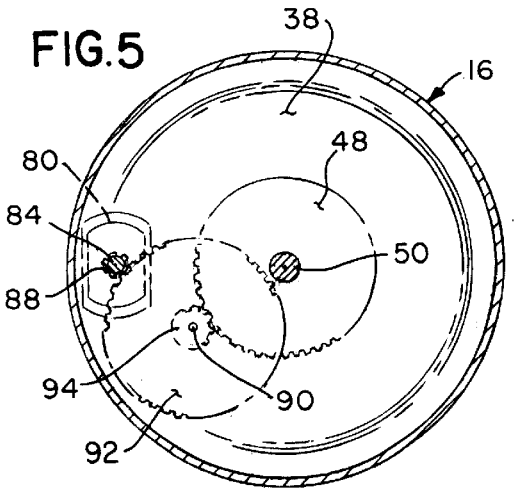
FIG.7
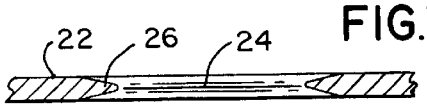
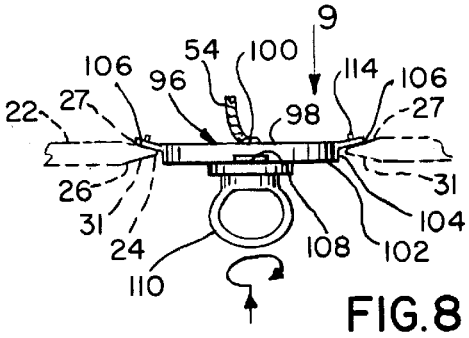
FIG.8

ROTATING DISPLAY DEVICE

BACKGROUND OF THE INVENTION

The present invention relates to a rotating display device. More particularly, the present invention relates to a rotatable display device that is suspendable from a ceiling and allows a planter to be rotatably suspendable therefrom and which includes a shallow and bowl-like lower housing, a shallow and inverted bowl-like upper housing that is replaceably attached to the shallow and bowl-like lower housing, a top hanger assembly that extends upwardly from the shallow and inverted bowl-like upper housing and suspends the rotatable display device from the ceiling and provides a means for grabbing the shallow and inverted bowl-like upper housing when the shallow and inverted bowl-like upper housing is to be removed from the shallow and bowl-like lower housing, a rotatable plate that is contained in, and rotatable relative to, one of the shallow and bowl-like lower housing and the shallow and inverted bowl-like upper housing, a bearing assembly that rotatably connects the rotatable plate to the other of the one of the shallow and bowl-like lower housing and the shallow and inverted bowl-like upper housing, a large and horizontally-oriented driven gear that is fixedly attached to, for rotation with, the rotatable plate, a bottom hanger assembly that extends downwardly from, and rotates with, one of the rotatable plate and the large and horizontally-oriented driven gear for rotatably suspending the planter therefrom, a motor contained in the other of the one of the shallow and bowl-like lower housing and the shallow and inverted bowl-like upper housing for rotating the rotatable plate, a motor shaft that extends from the motor, a small and horizontally-oriented motor driver gear that is fixedly attached to the motor shaft for rotation therewith and is contained in the shallow and bowl-like lower housing wherein the small and horizontally-oriented motor driver gear is smaller than, and is rotatably operatively connected to, the large and horizontally-oriented driven gear, so that when the motor shaft rotates, the small and horizontally-oriented motor driver gear rotates, which in turn rotates the large and horizontally-oriented driven gear, which in turn rotates the rotatable plate and the bottom hanger assembly which is suspended from the one of the rotatable plate and the large and horizontally-oriented driven gear, and which in turn rotates the planter suspendable therefrom.

Several existing schemes address the idea of rotating a plant, either hanging or table top, for the purpose of displaying or for affording uniform exposure to a light source.

These schemes, however, provide no provisions for developing sufficient torque from a small battery powered motor to effectively rotate a large hanging plant or provisions to limit the acceleration rate of the plant so as to reduce "swirling." No address has been made to the limited power or the frictional and compressive loads presented on the articulating surfaces or for provisions for a user to adjust the rotation rate. No effort has been made to address the need to easily access a hanging plant with a removably secured spring loaded hook or has an individual addressed the multi-functional capability of serving as both a hanging plant rotator or a table top rotator depending upon the particular needs of the user.

Numerous innovations for rotatable display devices have been provided in the prior art that will be described. Even though these innovations may be suitable for the specific individual purposes to which they address, however, they differ from the present invention in that they do not teach a rotatable display device that is suspendable from a ceiling and allows a planter to be rotatably suspendable therefrom and which includes a shallow and bowl-like lower housing, a shallow and inverted bowl-like upper housing that is replaceably attached to the shallow and bowl-like lower housing, a top hanger assembly that extends upwardly from the shallow and inverted bowl-like upper housing and suspends the rotatable display device from the ceiling and provides a means for grabbing the shallow and inverted bowl-like upper housing when the shallow and inverted bowl-like upper housing is to be removed from the shallow and bowl-like lower housing, a rotatable plate that is contained in, and rotatable relative to, one of the shallow and bowl-like lower housing and the shallow and inverted bowl-like upper housing, a bearing assembly that rotatably connects the rotatable plate to the other of the one of the shallow and bowl-like lower housing and the shallow and inverted bowl-like upper housing, a large and horizontally-oriented driven gear that is fixedly attached to, for rotation with, the rotatable plate, a bottom hanger assembly that extends downwardly from, and rotates with, one of the rotatable plate and the large and horizontally-oriented driven gear for rotatably suspending the planter therefrom, a motor contained in the other of the one of the shallow and bowl-like lower housing and the shallow and inverted bowl-like upper housing for rotating the rotatable plate, a motor shaft that extends from the motor, a small and horizontally-oriented motor driver gear that is fixedly attached to the motor shaft for rotation therewith and is contained in the shallow and bowl-like lower housing wherein the small and horizontally-oriented motor driver gear is smaller than, and is rotatably operatively connected to, the large and horizontally-oriented driven gear, so that when the motor shaft rotates, the small and horizontally-oriented motor driver gear rotates, which in turn rotates the large and horizontally-oriented driven gear, which in turn rotates the rotatable plate and the bottom hanger assembly which is suspended from the one of the rotatable plate and the large and horizontally-oriented driven gear, and which in turn rotates the planter suspendable therefrom.

For Example, U.S. Pat. No. Des. 243,808 to Helm teaches the ornamental design for a hanging container for potted plants.

Another Example, U.S. Pat. No. Des. 244,013 to Perkins teaches the ornamental design for a hanging container for rooting plants.

Still Another Example, U.S. Pat. No. Des 258,206 to Bourke teaches the ornamental design for a rotatable plant container unit.

Yet Another Example, U.S. Pat. No. 3,882,634 to Dedolph teaches a rotary plant growth accelerating apparatus for increasing plant yields by effectively removing the growing plants from the constraints of gravity and increasing the plant yield per unit of space. The apparatus includes a plurality of cylindrical plant beds supported radially removed from a primary axis of rotation, with each plant bed being driven about its own secondary axis of rotation and simultaneously moved in a planetary path about the primary axis of rotation. Each plant bed is formed by an apertured outer cylinder, a perforated inner cylinder positioned coaxially therewith, and rooting media disposed in the space therebetween. A rotatable manifold distributes liquid nutrients and water to the rooting media through the perforations in the inner cylinders as the plant beds are continuously rotated by suitable drive means.

Still Yet Another Example, U.S. Pat. No. 3,909,978 to Fleming teaches a method for growing plants from seeds or small seedlings wherein the latter are first planted in open tray-like containers that are secured to an elongated rotatable module or core support about its longitudinal axis of rotation. The core support with its containers is moved at a slow speed through a controlled, growth enhancing environment as it also rotates at a constant rate. An apparatus for accomplishing the method comprises a continuous chain means driven by first drive means at a constant rate and to which are attached a series of module supports that are simultaneously rotated by second drive means as they are moved along through a controlled environment. Each module support provides a mounting frame for retaining a plurality of removable plant containers or trays for growing plants or seedlings.

Yet Still Another Example, U.S. Pat. No. 3,930,334 to Johnston teaches a hanging plant which includes a pair of liquid receptacles which are supported in respective top and bottom positions with the top liquid receptacle being substantially directly above the bottom receptacle. The top liquid receptacle is capable of dropping liquid from a plurality of locations to the bottom liquid receptacle. The bottom liquid receptacle is positioned for and is capable of receiving the falling liquid so as to enable a multiple falls effect. At least one other receptacle is capable of supporting a hanging type plant. This plant receptacle is positioned above the bottom liquid receptacle. The plant receptacle has a periphery which is different from the outside envelope of the falling liquid, so that the hanging plant will not interfere with the falling liquid.

Still Yet Another Example, U.S. Pat. No. 3,932,958 to Kistler, Jr. et al. teaches a plurality of posts mounted upright from a supporting surface and arranged in longitudinally and transversely aligned rows to form a series of adjacent rectangles. A plurality of parallel and substantially uniformly spaced wires extend longitudinally of the posts and are connected to the upper ends of the longitudinally aligned posts. The opposite ends of the longitudinal wires are anchored at the supporting surface. A plurality of parallel and uniformly spaced transverse wires are connected between each pair of adjacent longitudinal wires at uniform intervals therealong. The intervals being only a fraction of the distance between the adjacent longitudinal wires. The transverse wires being substantially coplanar. A plurality of elongated, spaced and parallel elements are connected by flexible means, so that the elements can be stored in a roll which can be mounted upon and then unrolled along a pair of the transverse wires between a pair of longitudinal wires. By this means, the amount of light reaching the surface surrounded by rectangles can be controlled.

Yet Still Another Example, U.S. Pat. No. 3,950,637 to Rodin teaches an artificial light source and container apparatus for growing plants. The apparatus includes a paraboloid dome defined by a discharge aperture. A light source is positioned in the dome preferably at the focal point thereof. A support carriage and platform is positioned in the discharge region of the dome and is adapted for alignment along the central longitudinal axis of the dome. A container is hung from the platform to intercept substantially all of the light from the light source.

Still Yet Another Example, U.S. Pat. No. 3,973,353 to Dedolph teaches a plant growth accelerating apparatus for increasing plant yields by effectively removing the growing plants from the constraints of gravity and increasing the plant yield per unit of space when the light intensity incident on the apparatus varies. The apparatus includes a plant bed mounted for turning about the longitudinal axis thereof and a drive structure for periodically tilting the longitudinal axis of the plant bed while relatively low light intensities are incident thereon to impart thereto a slope from about 0.01 to about 0.25 to decrease the respiration rate of plants growing on the plant bed. A structure applies the tilting structure to a multiple plant bed machine, as well as gravitational watering structure for multiple plant beds while turning the same.

Yet Still Another Example, U.S. Pat. No. 3,990,179 to Johnson et al teaches a pot for plants primarily used for a hanging pot. The pot includes at least two interlocking, stacked sections, the lower of which has a plurality of spaced, upwardly open, downwardly extending slots or notches defined in its upper edge of size, so that plant stems and branches in the lower section can be laid through the openings with the upper section of the pot removed. The upper section can be placed on the lower section to hold the stems in position extending through the slots in the side wall of the finished pot.

Still Yet Another Example, U.S. Pat. No. 3,998,007 to Martin teaches a multiple-shelved. The unit is adapted for use in greenhouses and for supporting growing plants on the shelves thereof. The unit includes a horizontal hollow shaft mounted for rotation and means for rotating the same. Hub members are carried by the shaft adjacent the ends thereof with each hub member supporting a plurality of radially-projecting hollow spokes and hollow elements carried by the spokes adjacent the outer ends thereof for pivotally supporting the shelves. The unit additionally includes means for connecting the hollow interior of the shaft to a water supply, means for providing water communication between the interior of the shaft and the interiors of the spokes supported by at least one of the hubs, and means for providing water communication between the last mentioned spokes and the shelves whereby the plants supported by the shelves may be watered at desired intervals. A second similar unit may be employed with its hollow shaft in alignment with and connected to the hollow shaft of the first unit for rotation therewith. The connection in such case includes valved means for the passage of water from the shaft of the first unit to the shaft of the second unit. An additional feature is the construction of the hub members which provides both a threaded and clamped connection with the spokes for insurance against the breaking of such connection.

Yet Still Another Example, U.S. Pat. No. 4,001,959 to Grendahl teaches an interior decorating apparatus. The apparatus includes a three-dimensional picture frame. Means are provided for displaying a plurality of pictures around the periphery of a polyhedral or semipolyhedral body in a plurality of openings defined by a top, a bottom, and spacers extending therebetween and grooved to support, display, and protect the pictures. Arrangements are shown for supporting the apparatus rotatably from below, suspending it from above, or securing it to a wall. The apparatus is specially apertured, so that a potted plant may be used in connection with the pictures. Other decorative arrangements using the apparatus are suggested.

Still Yet Another Example, U.S. Pat. No. 4,005,843 to Wengel teaches a rotator for a hanging display such as a mobile, hanging plant or the like having a self-contained power supply. The apparatus comprises a cylinder for containing flashlight batteries adjacent one another and for containing motor means to drive a geared shaft by which a display is suspended and rotated. Off-On operation and series battery interconnection are effected by the positioning of a rotatable, electrically conductive circular top plate confronting the ends of the batteries. An opening in the rotatable plate is provided for replacement of the batteries. A tab on the top plate permits the plate to be rotated and to be suspended.

Yet Still Another Example, U.S. Pat. No. 4,026,067 to Wengel teaches a plant turntable having a power supply for the rotation of a potted plant and the like. The turntable includes an imperforate disc supported by a ring-mounted ball bearing assembly for the support of the potted plant which is driven by the shaft of a geared motor mounted directly below in a base. A transverse pin through the drive shaft engages a slot in the turntable axle to provide the driving torque for rotating the turntable. The base forms a motor and battery enclosure. The top of the base includes a ridge adjacent to the periphery of the base beyond the rim of the disc to capture water which may gravitate from a potted plant resting on the disc, and further includes a ridge about the motor shaft to protect the motor from water leakage through the shaft hole. The top further includes a plurality of openings for draining water therefrom. The lower portion of the base includes a concealed reservoir isolated from the motor and battery enclosure about the periphery thereof for capturing and draining water from the base top, thereby preventing damage to enclosed components.

Still Yet Another Example, U.S. Pat. No. 4,026,220 to Schuring, Jr. teaches a portable plant stand for holding potted plants formed of easily assembled flat wood components. The stand comprises a tapered vertical support column that supports horizontal shelves having pot holding openings. The shelves include central apertures that fit over the support column and engage the tapered sides of the support column. The support column has an H-shaped cross section and comprises opposed tapered members and a tapered cross member that is removable fastened to the side members by two screws. The support column can be mounted on bearings to permit rotation of the plant stand.

Yet Still Another Example, U.S. Pat. No. 4,051,627 to Schilling, Jr. teaches a device for automatically caring for potted plants that includes a rotary support carrying a potted plant and supported by a suitable base on which there is a container for liquid to be fed to the potted plant. The rotary support is driven so as to be rotated at a speed according to which the time required for one revolution of the rotary support does not form a multiple or fraction of 24. The container for the liquid is flexible while the rotary support carries at least one cam to compress the container in order to discharge liquid out of the latter A feed tube extends from the container to the potted plant to deliver liquid thereto each time the cam compresses the container. A stationary tilling element is carried by the base at a position for tilling soil in a pot of a potted plant. The rotary movement of the potted plant with the rotary support displaces soil in the potted plant with respect to the stationary tilling element, so that the soil becomes tilled while the support for the potted plant turns.

STILL YET ANOTHER EXAMPLE, U.S. Pat. No. 4,059,920 to Worrell teaches a hanging flower pot assembly wherein a dish is positioned beneath a flower pot in spaced relation thereto so as to receive water which passes through the bottom of the flower pot thus providing drainage for the roots of plants within the flower pot avoiding excessive soaking thereof as may cause rotting. The dish may be positioned in spaced relation beneath the flower pot by providing spaced projection carrying camming means for passing through and engaging a central opening within the bottom of the flower pot. Spaced protuberances are provided for maintaining the spacing between the dish and the flower pot.

Yet Still Another Example U.S. Pat. No. 4,068,405 to Campbell et al teaches an apparatus and method for establishing and maintaining a controlled environment for the growth of food yielding plants. The apparatus includes an enclosure having a plurality of artificial light sources positioned over a growing region. Planting areas constitute suitable trays which are mounted for automatic or controlled movement past the light sources and to a work area where all planting, cultivating, crop management, and harvesting is accomplished. Photo periodism or the enhanced growth rate of plants with light cycling is easily optimized by controlling the speed of movement of the plants. Size and position of the lamps also is varied to optimize growth. Growth enhancement through plant movement is attained.

Still Yet Another Example, U.S. Pat. No. 4,068,761 to McCarthy teaches an apparatus for supporting and displaying plants in a window, that is readily adaptable to windows of various sizes and provides not only relocatable supporting platforms for potted plants but also relocatable pegs from which hanging plants may be displayed.

Still Another Example, U.S. Pat. No. 4,097,015 to Frishman teaches a rotatable ceiling hook for plants and the like. The hook is shaped in the form of a helix which is secured to a support at a point midway between its ends by a suitable means such as a screw to provide a strong and balanced ceiling hook. Interposed between the screw and the helix is a base and a washer separated by a rigid cylindrical spacer. The helix rotates around the spacer, thus providing easy rotation even when the screw is firmly attached to a support and the hook is heavily loaded.

Still Yet Another Example, U.S. Pat. No. 4,101,036 to Craig teaches a hollow support column that rises from a floor pad and terminates in an adjustable shaft within the top of the column which in turn supports articulated ceiling thrust arms. The arms diverge from the axis of the column and are padded for contact with the ceiling. Preferably three arms are used and their articulation adapts to use near corners and vertical walls and against uneven ceilings. A lock collar positions the thrust arms above the column for compression fastening between the floor and ceiling. A plurality of fastener bands is fixed to the outside of the column. The bands are pierced to receive pairs of fastener pegs on each of a plurality of support arms which cantilever outwardly from the post. The arms may support a variety of objects such as plants, artistic mobiles, tables, hydroponic planters, and other objects of some considerable mass since the ceiling thrust arms establish a force triangle with the floor pad as the apex, greatly increasing the capacity of the pole to support weight displaced from the vertical axis of the pole.

Yet Still Another Example, U.S. Pat. No. 4,102,081 to Morrow teaches an improved plant and flower container of the hanging type. The container comprises a pot having a removable false bottom to provide a compartment for collecting and storing excess water for subsequent absorption by the plant. A single hanging rod is removably attachable to the central bottom portion of the pot for hanging support thereof. Means on the central axis of the pot beneath the bottom surface thereof supportably receive the hook portion of another plant container hanging rod whereby a plurality of such containers may be supported in compact, vertically spaced relation during plant growth. Several embodiments of the plant container are disclosed and the containers are so designed as to be readily stored in compact, nested relation prior to use, and may be quickly and easily assembled to be used in greenhouse and home to provide a compact aesthetically attractive arrangement of hanging plant containers.

Still Yet Another Example, U.S. Pat. No. 4,109,415 to Hall teaches an apparatus for use in caring for plants or horticultural items. The apparatus comprises a generally cylindrical member having stepped areas of varying diameter progressing from a large diameter to a small diameter wherein flower pots or the like of different diameters can be accommodated by the instant apparatus. In addition, the apparatus includes strap members or the like for hanging the apparatus from hanging baskets, pots or the like. The apparatus is useful as a catch basin or drip pan for receiving residue from a flower pot or the like during a watering process. Alternatively, the apparatus may be used as a watering pan for plants or the like which require prolonged soaking or watering.

Yet Still Another Example, U.S. Pat. No. 4,117,627 to Slingerland, Jr. teaches a freely rotatable, effectively tilt-free stand for carrying plants and the like. The stand includes a plurality of relatively rotatable members cooperatively defining a ball bearing structure wherein the ball bearings are disposed in an annular array at the periphery of the assembly so as to provide an effectively tilt-free rotation thereof. Support of the structure relative to the bearings is effected by metallic bearing plates which may be adhesively secured to other elements of the structure. The base member may have a lateral extent substantially greater than that of the rotatable portions to provide further tilt-free stability.

Still Yet Another Example, U.S. Pat. No. 4,117,630 to Kalas teaches a revolving hanger for a planter in which a motor is employed to revolve the hanger support. The motor is preferably a weight operated motor with suspended weights which are located in the area normally occupied by the cords supporting the planter so that the weights are relatively unobtrusive. Because of the use of a weight wound motor, it is possible for the user to readily wind the motor while standing on the floor by moving the weight to the desired elevated position for initiation of the rotation of the planter.

Yet Still Another Example, U.S. Pat. No. 4,149,339 to Hall et al. teaches a plant holder formed of flexible material and having a pocket for a plant, a water reservoir, and straps for hanging the device from a curtain rod or other suitable support.

Still Yet Another Example, U.S. Pat. No. 4,159,094 to Stekoll et al. teaches a plant hanger assembly and supporting spring steel chain element that includes a round, flat bottom pan with sidewalls positioned substantially 11 degrees to the vertical and chain links of 13 gauge spring steel three inches long which can be snapped together for hanging pans one above the other.

Yet Still Another Example, U.S. Pat. No. 4,167,908 to Jones et al. teaches a suspendable plant rack that facilitates the close packing of a plurality of plans in a given area, for example, in exposure to direct sunlight at a window area. The rack shelves are formed by plural separated slats and the vertical side supports are similarly formed, thus enhancing air circulation characteristics about the rack. In one embodiment, the shelves are held balanced by mechanical tie-downs and in another embodiment a cooperative notch arrangement assures such balancing.

Still Yet Another Example, U.S. Pat. No. 4,170,843 to Talwani teaches a plant-mobile that is a rotating plant hanger which includes a rotatable frame adapted to support a number of hanging plants. Embodiments of the plant-mobile are adapted to be mounted either from a wall or a ceiling. The plant-mobile includes an associated ceiling or wall mounting means. The rotatable frame includes round balls or hooks from which potted plants may be hung. In addition, the rotatable frame includes radial members which may be used to support the shoots of climbing plants or vines.

Yet Still Another Example, U.S. Pat. No. 4,175,354 to Anderson teaches a plant growing device that includes a two sectional base having an upper and a lower portion. A mechanism is provided for the controlled rotation of the upper portion relative to the stationary lower portion. A flower pot containing a plant is positioned on top of the upper portion. A mechanism for delivering a controlled supply of water is coupled to the mechanism for rotation.

Still Yet Another Example, U.S. Pat. No. 4,187,996 to Ehrlich teaches a device for adjustably supporting potted plants or similar articles from a room ceiling or beam in such manner that it may be conveniently lowered for watering or other attention and subsequently returned to display position. The device includes a housing element having a keyhole opening therein for engaging a concealed anchor and a loop supported by a cord on a spring roller. The roller having latching means for supporting the weight of the plant or other supported article. The latching means is released and re-engaged by horizontal movement of the supported article which moves the cord to other than vertical position.

Yet Still Another Example, U.S. Pat. No. 4,188,891 to Boyajian teaches a support structure for holding house plants or the like in position to receive optimal sunlight at a window. The structure comprises a pair of elongate support members which rest on the window sill and extend upwardly into the room. C-hooks attached to the base of the support members pass over the nosing of the window trim and prevent slippage. Cables extend between eyes screwed into the window track and the top of the support members. The support members hold one or more shelves, each of which comprise a plurality of parallel rails extending horizontally between rail holding brackets. The brackets define holes dimensioned to interfit with the support members and to slide therealong. When a load is placed on the rails, vertical slippage of the shelves is prevented by a gripping action exerted by the rail holding brackets on the support members. The structure is both vertically and horizontally adjustable, fits variously sized windows, is easily assembled and disassembled without tools, does not interfere with the operation of the window sash, blinds, shades etc., and can be conveniently stored or transported as a compact collection of dowels or the like.

Still Yet Another Example, U.S. Pat. No. 4,189,124 to Faris teaches an apparatus which facilitates the controlled rotative positioning of a planter suspended from an overhead support. The apparatus is comprised of two facing toothed members, a vertically disposed pull rod and associated bearing pin, position restoring means acting upon the pull rod, and harness means to maintain the several components in proper spaced alignment. The apparatus is attached to an overhead support. A planter is attached by tether means to the pull rod. The apparatus causes the planter to undergo controlled horizontal rotative movement when the planter is momentarily pushed upward to remove the downward force acting upon the pull rod, and then released.

Yet Still Another Example, U.S. Pat. No. 4,216,619 to Espy teaches a horticulture device for rotating a plant as moisture transpires from the plant and evaporates from the container holding the plant. The device includes a spring which is linearly distorted due to gravity as the plant is watered and which is restored as the plant releases the water and the water evaporates from the container. The spring is connected to a motion converting mechanism that converts linear distortion of the spring to rotational motion which in turn is used to rotate the plant.

Still Yet Another Example, U.S. Pat. No. 4,220,306 to Cueto et al. teaches an adjustable hanging device for hanging plants and the like having a cord with a hook at its upper end for suspending same. The cord extends downwardly through a bore at one end of a bar and returns upwardly to terminate at a second bore at the other end of the bar with a second hook positioned at the bend of the cord. An object suspended on the second hook such as a plant causes the bar to tilt downwardly and the cord to become crimped at the bar and thereby lock the cord in position. Upon pushing upwardly on the lower end of the tilted bar to a horizontal position by means of a pole, the position of the bar frees the cord and permits the height adjustment of the device.

Yet Still Another Example, U.S. Pat. No. 4,227,343 to Epsy et al. teaches a container for plants that is rotated as water is evaporated and respirated therefrom due to the interaction between a compression spring and linear-to-rotary motion mechanism. The compression spring is disposed between the container and a stop on a support shaft suspended from above. The support shaft has a spiral portion thereon and the container has a slot for receiving the spiral portion. As water evaporates, weight on the compression spring is reduced and the container rises upwardly on the shaft in relation to the stop on the shaft. As the container rises, it rotates slowly. In an alternative embodiment, the shaft is rigidly fixed to a base upon which the container rests and the container includes a soil containing pot which may move relative to the base. The compression spring is disposed between a stop on the shaft and the soil containing pot to bias the pot upwardly when there is no water therein so as to raise and rotate the pot with the linear-to-rotary motion mechanism as the water evaporates.

Still Yet Another Example, U.S. Pat. No. 4,306,280 to Burke teaches an adjustable device for supporting articles, such as lamps and potted plants. The device includes a stationary support member which is fixedly attached to a wall or other upstanding foundation. A coupling mechanism is movably connected at a first end to one end of the stationary support member. A swivel member is connected to a second end of the coupling mechanism by means of a pivot member to permit rotation of the swivel member along an arcuate path in a generally horizontal direction. In addition, a chain or cord interconnects the swivel member and the stationary support member to permit vertical movement of the swivel member relative to the stationary support member. Thus, a lamp or plant holder may be secured to the chain for convenient movement to a number of desirable, alternative positions.

Yet Still Another Example, U.S. Pat. No. 4,314,646 to Purnell teaches a device for hanging plants which comprises a pair of spaced board-like members. Disposed perpendicularly between and joining the boards are dowels. The dowels have apertures therethrough for receiving and support a rod. The dowels are so spaced such that the rod passes through aligned apertures in the dowels. The rod is disposed at least midway within and between the spaced boards so that the hook of a hanger for a hanging plant, or the like, suspended from the rod, is substantially hidden from view. In an alternate embodiment, a fluorescent fixture may be disposed about the dowels so as to provide lighting for the plants.

Still Yet Another Example, U.S. Pat. No. 4,323,215 to Berger teaches a hang-up fixture for ceiling mounting adapted to have a twist-lock releasable connection with a ceiling element to provide a support for a hanging article such as a display sign, or banner in a store, or a hanging plant, or lamp, or the like.

Yet Still Another Example, U.S. Pat. No. 4,373,695 to Faris teaches an apparatus which facilitates the controlled rotative positioning of a suspended planter. The apparatus is comprised of a cylindrical outer member and an internal member in sliding engagement with said outer member and coaxially positioned therewith. The internal member is provided with two spaced arrays of teeth so arranged that, when one member is upwardly displaced with respect to the other member, bearing means associated with said outer member induce rotative motion of one of said members. Restoring means acting between the members causes the upward displacement when downward force is removed therefrom. Attachment means associated with each member facilitates suspension of the apparatus from an overhead support and suspension of a planter from that member which undergoes rotative motion.

Still Yet Another Example, U.S. Pat. No. 4,385,742 to Rocquin teaches a support for suspending a flower pot from an overhead structure. In one embodiment, the device comprises an annulus for engagement with the lower surface of a shoulder on the pot. The annulus has lateral projections for engagement with suspending hooks. In another embodiment, the device comprises an annulus for engagement with the lower surface of an annulus lip on a plastic flower pot. The annulus has a plurality of projections extending upwardly through slots in the lip for engagement with suspending hooks.

Yet Still Another Example, U.S. Pat. No. 4,389,813 to Jaques et al. teaches a planter in the form of a hollow tree configuration having a trunk, branches extending laterally therefrom and having a support means attached to the top or bottom of the trunk for supporting the trunk of the tree configuration in a substantially vertical position. The planter may comprise a drainage sump for the planter at its base for humidifying with the drainage liquid the plants in the planter and a light fixture at its top for reflecting light rays onto the plants growing in the planter.

Still Yet Another Example, U.S. Pat. No. 4,446,653 to Morgan, Jr. teaches a device for supporting a hanging plant and for slowly rotating it to expose different sides to sunlight. The device comprises a cord for attachment at one end to a hook or other fixed object and for attachment at the opposite end to the plant. The cord extends in length and winds in one direction in response to an increase in the weight of the plant by feeding of water and contracts and winds slowly in an opposite direction as the water evaporates from the plant.

Yet Still Another Example, U.S. Pat. No. 4,449,324 to Ostarly teaches a hanging planter having a support arm rigidly attached to the bottom of the container at its bottom portion. A medial portion is attached to the sidewall of the container and an upper portion comprising a windvane-like support arm limits rotational movement of the container to 90 degrees.

Still Yet Another Example, U.S. Pat. No. 4,543,744 to Royster teaches a growing chamber defined by sidewalls and a top spanning the chamber inside the walls. The top is mounted to be vertically moveable to change the chamber height. The walls and top are coated to be ninety percent reflective. A horticultural lamp is mounted on the top and a timer turns it on and off. Carbon dioxide gas is supplied to the chamber. The gas being controlled to be supplied intermittently, but only while the lamp is on.

Yet Still Another Example, U.S. Pat. No. 4,556,184 to O'Sullivan teaches an extendible ceiling hook that comprises an apparatus for suspending a hanging plant at various distances from a ceiling for the purposes of ease of maintenance, appearance, and the general well being of the plant. An extension line, wound on an extension spool inside the extendible ceiling hook may be reeled in or out or made to rest at a desired distance from the ceiling by raising or lowering the suspended plant pot in a controlled fashion. The suspended plant can be easily rotated to any desired angle to fully exploit any available sunlight and further enhance its appearance.

Still Yet Another Example, U.S. Pat. No. 4,574,521 to Landy teaches a device, which consumes little power while producing an automatic, periodic, partial rotation of a hanging planter. The device has a low-power consumption electronic timing circuit, an electric motor, a power supply and electronic and mechanical means to start the motor upon signal from the timing circuit and rotate the planter and stop it after sufficient rotation has occurred. The device is designed so that it can operate for many months using a small power supply such as a flashlight battery and to be as inconspicuous and aesthetically unobtrusive as possible.

Yet Still Another Example, U.S. Pat. No. 4,583,323 to Graves et al. teaches a horticultural apparatus that hangs from an overhead support or rests on a table or the like for rotating plants housed in at least one of a flower pot planter or a hanging basket planter to promote symmetrical growth by allowing more equal exposure of the plant to light. The apparatus comprises a support base, a housing rotatively supported on the support base and having a peripheral support wall with an outwardly extending lip secured about the lower portion of the support wall, rotating apparatus within the support base which communicates with the housing for rotating the housing about the support base, and apparatus detachable from the housing for supporting the flower pot planters or hanging basket planters. The supporting apparatus is positioned about the peripheral support wall and rests on the lip of the housing.

Still Yet Another Example, U.S. Pat. No. 4,592,166 to Tendrup et al. teaches a planter formed of two sections, one disposed within the other, in which cooperating projections provided on the sections must slide over each other during the disassembly thereof, so that there is frictional resistance which obviates inadvertent disassembly of the planter.

Yet Still Another Example, U.S. Pat. No. 4,601,453 to Kagan teaches a hanger support suitable for use or reuse in hanging a receptacle or planter. The support comprises a hanger from which the hanger support may be secured. The hanger has a plane or zone disposed or oriented in the vertical direction. A take-up reel has an endless channel defined between a pair of walls extending from either end of the reel. The reel is secured to the hanger for accumulating material supporting the planter or other item. The reel incorporates a plane or zone disposed in the vertical direction when the hanger support is secured for use. A lock is vertically below the reel and hanger offset to the plane or zone of the take-up reel, but in vertical alignment with the plane or zone of the hanger.

Still Yet Another Example, U.S. Pat. No. 4,622,776 to Pfaff teaches a hanging planter having a pot and separate stringers for suspension. The pot is formed with at least a pair of loops integral with its lips into which the stringers are held for transportation, display, and storage.

Yet Still Another Example, U.S. Pat. No. 4,622,777 to Greene, Jr. teaches a rotatable planter and a method of producing such planter. The planter includes a thermoplastic tube with a plurality of pockets therein, a bottom, and means for supporting the tube so that it is rotatable either by the wind to which it is exposed or by a stand on which it is supported. The improved method includes the steps of cutting a plurality of radial slots in a tube of preselected length, heating the area above and below each slot and forming the upper portion of the pocket above the slot inward and forming the lower portion of the pocket below the slot outward.

Still Yet Another Example, U.S. Pat. No. 4,658,540 to Hougard teaches a hanging plant pot particularly for flowers. The pot consists of a vessel which at the top has an encircling edge flange provided with anchoring openings for a releasable hooking of the vessel on suspension means e.g. bars, chains or straps. The openings have an oblong shape with a maximum dimension essentially oriented radially in relation to the vessel axis. At the end which is defined to enter the openings, the suspension means has shaft part, the free end of which is provided with a pair of shoulders extending laterally in opposite directions from the shaft and which measured transversely to the shaft, and have a total extension which is larger than the smallest one of the openings, but at the utmost, as large as the largest internal cross-section of the openings.

Yet Still Another Example, U.S. Pat. No. 4,666,115 to Schiro teaches a hanger for plants on fences and other surfaces. The hanger consists of a support member with strengthening members and a holding member which extends from both sides of the support member and is positioned near the rear of the hanger. The front of the support member is provided with both a hole and a peg which are for hanging plants or other items. A stop block allows the positioning of the support member against the fence. The stop block may be either fixed or adjustable. A mounting block is provided for using the hanger on structural surfaces such as walls.

Still Yet Another Example, U.S. Pat. No. 4,691,473 to Ragen teaches a circular plant mobile that comprises a plant pot supporting ring and a hanging hoop that are pivotally related to one another and may be locked either in plant supporting position with the ring at right angles to the hoop or in a position in which the ring and the hoop lie in the same plane for storage or shipping. The lock is made more secure because it is secured against unlocking by the presence of the pot within the ring. Pot supporting brackets, that may be hung from the ring, further increase support for a pot or to alter its location.

Yet Still Another Example, U.S. Pat. No. 4,825,589 to Straw et al teaches a useful device in combination with a conventional type hanging plant support for quickly and easily lowering a potted plant from its uppermost hanging position for servicing and returning. The device provides a surface on which a potted plant is placed and embodies a spring powered reel below the supporting surface with three cables of suitable strength partially wound thereon extending out of and equally spaced about its perimeter to form part of the total support. Thus, providing means of lengthening the support as the reel unwinds and thereby lowering the plant for attention. Associated with the reel is a locking device or latch so that the suspended plant may be locked into any desired position within its total vertical movement. The assembly and locking device can be grasped and actuated at a point centrally below the support so that rectilinear vertical movement to any desired elevation is readily achieved and maintained without tilting, disturbing, or spilling the contents of the supported pot. The axis of the reel is arranged for adjustment of the spring tension to counterbalance the variable weight of the compatible pots and potting materials and also for optimum ease of displacement throughout its total movement.

Still Yet Another Example, U.S. Pat. No. 4,837,972 to Reed teaches a straight-hanging tapered plant pot which includes a body composed of a side wall being tapered from a larger size at an upper end to a smaller size at a lower end and a bottom wall connected to the side wall at the lower end thereof. A hollow wedge-shaped projection is integrally connected with, and bridges an interrupted section of, the pot side wall. The projection projects outwardly from the body side wall so as to adapt the projection to support the pot body in an upright, non-tilted fashion from a vertical surface and position the pot bottom wall in a generally horizontal plane. The hollow configuration of the projection and tapered configuration of the pot body allow a plurality of the pot bodies with projections thereon to be compactly stacked together in nested relationship.

Yet Still Another Example, U.S. Pat. No. 4,873,790 to Laterza teaches a plant spinner designed to rotate potted plants, so as to evenly expose them to the rays of the sun. Primarily, it consists of a simulated flower that is adhered to a window pane and the petals of the flower are provided with a multiple number of solar cells that convert the rays of the sun to electric current that drives a motor that slowly rotates a potted plant that is suspended from the plant spinner. Each solar cell in the flower is capable of powering a separate plant spinner. The rotation of such potted plants provides for better growth because of them being evenly exposed to the rays of the sun.

Still Yet Another Example, U.S. Pat. No. 4,887,785 to Blaich teaches a hanger hook that is of modified S-shape and all parts of the hanging hook lie substantially in the same plane. The hook has utility particularly but not exclusively in hanging a bird feeder from a substantially horizontal tree branch and the like. The hook has a lower open loop providing a bite for receiving thereover the circular portion of a bird feeder or plant hanger. The hanger also has an upper open loop for receiving the branch. The hook resists efforts of squirrels, raccoons, or the like but not people to disassemble the hanger from the hook and to disassemble the hook from the branch.

Yet Still Another Example, U.S. Pat. No. 4,896,455 to Kuban teaches a plant starter apparatus for allowing a plant seedling to receive light from a multiplicity of directions. A parabolic reflector is positioned such that light striking the parabolic reflector is reflected towards a focal point. A plant container containing both soil and plant seed is positioned such that, upon germination, the plant seedling receives both incident light and the light reflected from the parabolic reflector. As the plant seedling grows, the seedling receives ever-increasing amounts of light reflected from the parabolic reflector. Because the plant seedling receives light from the multiplicity of directions, growth of the plant seedling is maximized as the plant grows vertically.

Still Yet Another Example, U.S. Pat. No. 4,899,489 to Shishkin teaches a device that comprises a hermetically sealed chamber whose interior space accommodates a perforated band held to a drive drum. Part of the chamber is made as a flexible tubing, one end of which is connected to the free end of the perforated band, and the other end is turned inside out and held peripherally in the chamber to form a hermetically sealed space along therewith. The interior space of the chamber is connected to the working agent and nutrient medium feeding systems.

Yet Still Another Example, U.S. Pat. No. 4,908,982 to Quatrini teaches a one piece rubber coated metal rod bent into a series of angles to provide one end that slips onto and engages a square wooden post (4"×4", 6"×6", or 8"×8") with the other end angularly extending outwardly therefrom and provided with an end hook portion to support a suspended hanging plant, or the like. The hanging basked support may be used with a half-barrel type container having a layer of water absorbent material in the bottom thereof. A square wooden post has one end thereof received by the container and is supported by bracket(s). A perforated washer-like bushing having a periphery conforming to the interior of the container is positioned around the post and is supported thereon by brackets. A layer of decorative gravel or stone and/or a layer of artificial grass or porous indoor-outdoor carpeting is provided on the disk for aesthetic purposes. One or more hanging basket support brackets are disposed in frictional engagement with the post to support flower or plant baskets. The entire assembly is easily assembled and disassembled and is adaptable for apartment or condo use where the use of nails, screws, and other permanent type supports are prohibited.

Still Yet Another Example, U.S. Pat. No. 4,991,344 to Carney teaches a device for hanging plants, port or the like. The apparatus is comprised of a hollow center post having modularly pieced components upon which is mounted radially extending arms and legs. A center hub is provided for mounting the radially extending arms and legs to the center post. The center post is adapted for being supported in its upright position by various type means for mounting on the floor, a tree dolly, or for mounting directly into the earth.

Yet Still Another Example, U.S. Pat. No. 4,969,290 to Skoretz teaches an apparatus for even exposure of potted plants to sunlight. The apparatus includes a base, a potted plant receiving platter rotatably mounted to the base with the platter having an upstanding peripheral flange bounding an interior portion of the platter. A shroud is mounted to the base and defines a cowl which overlies the planter's peripheral flange to confine dirt and water to the interior portion of the platter. The platter has peripheral gear teeth, an electric motor, and a drive assembly that is coupled to the platter for rotation thereof at predetermined timed intervals. An optional wheeled carriage can be mounted to the base with the carriage wheels rotatably coupled for movement of a plant across a support surface. A set of slave units including rotatable platters can be interconnected together, and a powered master unit for simultaneous rotation of many plants.

Still Yet Another Example, U.S. Pat. No. 5,028,029 to Philipps et al teaches brackets that are held in place on a smooth surface by means of suction cups. Formed rod bracket elements are formed in a manner such that when the invention is in use, a portion of the bracket element becomes a fulcrum resting upon the flattened surface of the suction cup at a point generally below the central hub of the suction cup to which the bracket element is attached. A variety of bracket elements are contemplated such as for use in supporting potted plants, suspending hanging objects such as hanging plants or ornamental devices, and supporting shelves or small platforms.

Yet Still Another Example, U.S. Pat. No. 5,037,049 to Funk teaches a structure that is tree-like and has a tubular cruciform base, a vertical section and a plurality of tiers of limb-like structure, comprising a top tier, a bottom tier and at least one intermediate tier. The basic structure comprises one straight vertical tube and four bent tubular elements. The four elements each have a horizontal portion which is part of the cruciform base, a vertical portion which is part of the vertical section, and an arched top which is part of the top tier of limb-like structures. The tubular elements are integrated by spacers and clamps. The clamps also retain tubular sockets which hold the tubular limb-like structures of the bottom and intermediate tiers. A swivelled snap hook is attached to the free end of each limb-like structures of the bottom and intermediate tiers. A swivelled snap hook is attached to the free end of each limb-like structure to support a hanging plant.

Still Yet Another Example, U.S. Pat. No. 5,052,148 to Sharon et al teaches a plant container in the form of a plant pot (flower pot) having a bottom with a center opening and several water drain openings. The bottom is receivable in a circular pot tray formed with a center tubular pole that extends upward through the bottom center opening of the pot. An overhead suspended rope is passed through the center tubular pole and an adjustable position pot stopper with a position locking screw positions the plant pot on the hanging rope.

Yet Still Another Example, U.S. Pat. No. 5,065,971 to Gaube teaches a height adjustable device for suspending a planter that comprises a locking member adapted to be mounted above the planter, a handle member, and a cable attached at a first end thereof to the planter. The cable passes through the locking member and is wound around a reel biasedly mounted in the handle member with a second end of the cable being attached to the reel. The cable is partly wound around the reel. A disengageable brake is provided for the reel. The locking member comprises a pair of fixed wheels which guide the cable therethrough. The locking member further comprises a locking arm pivotally mounted therein and comprising a series of teeth. The locking arm is biased towards a first one of the wheels, whereby the cable can be secured between the locking arm and the first wheel. Tension provided in the cable by the handle member forces the locking arm away from the cable thereby releasing the same and allowing free movement thereof through the locking member and thus permitting the planter to be raised and lowered. To secure the cable between the teeth of the locking arm and the first wheel, a sudden slack is provided in the cable using the handle member in order to reduce the forces exerted by the cable on the locking arm in such a way that the locking arm is urged towards the wheel to imprison the cable therebetween. The disengageable brake allows the handle member to be positioned at various distances from the locking member by counterbalancing the forces of the biased reel provided in the handle member.

Still Yet Another Example, U.S. Pat. No. 5,077,936 to Beaven teaches a hanging plant holder which is height adjustable. A cable wraps around a pulley enclosed in the base of the plant holder and attaches to a hook in a ceiling. A braking and release mechanism in the plant holder allows the pulley to move in such a fashion that the cable is lengthened or shortened.

Yet Still Another Example, U.S. Pat. No. 5,152,099 to Nilssen teaches, particularly for use in wintertime, a plant rejuvenator in the form of a wall-hung shelf that is internally covered with reflective material. Along the rear wall of the shelf, in front of the reflective material, is positioned an array of fluorescent lamps. Within the shelf, in front of the fluorescent lamps, is placed one or more potted plants. Each plant is positioned on an automatically rotating pot base. Covering the front of the shelf is a partially transparent folding door. When closed, the door reflects some 90% of the light impinging upon it, but lets through the remaining 10%. A ventilation fan is arranged to maintain the temperature within the shelf at an optimum level. An automatic watering and feeding arrangement maintains the soil of each potted plant such as to promote effective plant growth. The light provided is intense enough to sustain a high degree of plant growth. The automatic rotation of the pots provides for even exposure to light. A plant may be placed in the plant rejuvenator for the purpose of display and/or for the purpose of being rejuvenated such as to permit it to remain in a healthy state outside of the rejuvenator for an extended period. Typically, a plant would be kept in the rejuvenator for a week or so. Thereafter, the plant would be able to maintain a good state of health for perhaps two weeks or so even if kept outside of the rejuvenator in wintertime.

Still Yet Another Example, U.S. Pat. No. 5,219,141 to Pecor teaches an offset bracket carried on a fulcrum ring or hook for adjustably positioning a hanging item, such as a lighting fixture or a planter, in relation to a ceiling or other overhead point. The bracket comprises an elongated fulcrum shaft pivotally engaging the fulcrum ring or hook. A hook is fixed to one end of the fulcrum shaft to carry the hanging item, and an adjustable bifurcated leg support is fixed to the other end of the fulcrum shaft. The leg support rests against the ceiling or an overhead support surface. Radial and angular adjustment of the fulcrum shaft on the fulcrum ring or hook provides offset positioning of the hanging item relative to the ceiling or other attachment point.

Yet Still Another Example, U.S. Pat. No. 5,224,293 to Sarb teaches an improved system for taking care of household plants that includes a plant holding basin for holding one or more plans, planters, or plant pots. The plant holding basin has a drain which is fluidly communicated to the indoors or household drainage system. Any water spilled or collected in the plant-holding basin is directed to the indoors or household drainage system. The plant-holding basin is installed near a water providing fixture which can provide water to the plant holding basin. The unit can be installed near a window so that the plants can not only have access to water and drainage, but also to sunlight. The plant-holding basin may or may not be integrated with a conventional sink.

Still Yet Another Example, U.S. Pat. No. 5,241,781 to Malczyk teaches a house plant hospital that comprises a closed container in which a potted plant may be positioned and covered by a hingedly-attached lid. A plurality of lights are mounted within the container, while the plant may be occasionally rotated by being positioned upon a "lazy Susan" support. In an alternative embodiment, provision is made for supporting several layers of plants and a water spray system is also provided. Additionally, fertilizer and pesticides may be sprayed over the plants while they are retained within the container. The closed container positionable over the plants operates to retain heat provided by the artificial light source so as to prevent the plants from being damaged in a cold environment. Further, the interior surfaces of the container and its associated lid are completely covered with a reflective mylar material which is unaffected by the liquid spray and which operates to continually reflect the artificial light in all directions so that maximum light availability is provided for the plants.

Yet Still Another Example, U.S. Pat. No. 5,269,488 to Lach teaches a supporting bracket for hanging decor such as decorative flags, banners, windsocks and planters, which is designed for attachment to a flat surface. The bracket includes a base portion and several elongated receptors for receiving a cylindrical pole to which the decor is attached. The bracket design is such that it is capable of accommodating different sized poles and displaying the decor at different angles. The bracket also includes screw holes for mounting to a planar surface and a set screw for securing the support shaft within the bracket.

Still Yet Another Example, U.S. Pat. No. 5,315,784 to Henehan teaches a device for rotating a hanging plant to keep it from growing lopsided. The device has counteracting coaxial tension springs of opposite hand that rotate the plant first in one direction when the plant is watered and then in the opposite direction as the plant goes from wet to dry. A weight change of 10–20% is sufficient to rotate the plant at least ½ turn. An indicator is responsive to changes in the length of the springs as the plant dries out and as the springs are axially unloaded.

Yet Still Another Example, U.S. Pat. No. 5,329,728 to Ray teaches a pot hanger for a vertically hanging pot with or without a drain saucer that includes a series of flat sheet, generally inverted U-shaped spaced clips. A lower distal end of the clips seats on a downwardly-facing surface of the plant container or the saucer while an upper distal end seats against an inner surface of a pot container or saucer peripheral circular ridge. One or a pair of apertures are formed in a bight portion of each clip with a bottom chain link of a corresponding series of chains affixed therein. The tops of all of the chains are fixed into a common swivel, snap or S-type hook. The hook is mounted on a provided support nail or screw hook. A tab is provided on each of the clips to facilitate removal of a clip from a pot container or saucer.

Still Yet Another Example, U.S. Pat. No. 5,333,409 to Mendes teaches a hanging pot with a plurality of tubular inserts which extend through the outer wall of the pot. The root portion of the growing plants are planted within the pot and the stalks of growing plants are extended through the tubular inserts so that they hang downwardly from the pot. The tubular inserts surround the stalks or stems of the plants and protect them from breaking under their own weight as they hang downwardly.

Yet Still Another Example, U.S. Pat. No. 5,337,986 to Vollink teaches a hanging-plant support assembly with a rigid object-support bracket with a post-engaging base, secured to a post by means of a post-engaging band with end hooks which hook over hooks on an attachment bar which extends through one of a plurality of apertures in the bracket.

Still Yet Another Example, U.S. Pat. No. 5,360,193 to Cobb teaches an apparatus for suspending a hanging plant that is housed in a container and includes three or more flexible supports each of which has a first end and a second end. The first end of each flexible support is adapted for hanging from an overhead supporting hook. The second end of each flexible support is attached together to provide an enclosure for retaining and for supporting the container. At least one of the flexible supports includes a fastener that is disposed intermediate to the first end and the second end. The fastener includes a slidable sleeve. The slidable sleeve can be displaced along the longitudinal axis of the flexible support to expose a coupling which can then be separated. Once the coupling is separated the flexible support also separates into two halves and the container can be readily removed from or inserted into the apparatus through the opening provided by the separated flexible support. When the slidable sleeve is displaced so as to cover the coupling, the coupling is thereby prevented from decoupling.

Yet Still Another Example, U.S. Pat. No. 5,390,443 to Emalfarb et al. teaches a railing hanger for hanging a plant from a deck rail. The railing hanger has a pair of substantially parallel planar brackets each including a pair of integral oppositely opening hooks. An upwardly opening hook on one bracket is joined with an upwardly opening hook on the other bracket by a plurality of transverse U-shaped stiffeners. The brackets and the stiffeners collectively define an upwardly opening container for receiving a plant. A downwardly opening hook on each bracket is selectively self connecting to the top of the railing and resists movement of the container laterally away from the rail. In an installed position, the container is spaced laterally from the railing and the bottom wall of the container is substantially horizontal. A rearwardly extending leg on the railing hanger prohibits movement of the container toward the rail.

Still Yet Another Example, U.S. Pat. No. 5,490,972 to Wianecki teaches an indoor plant growing apparatus that includes a hood disposed above an open-top plant receptacle for plants and a soilless medium. The hood contains optional lighting to provide illumination for a growing plant. A water reservoir is disposed below the plant receptacle and a wick is provided near the base of the container to draw liquid such as water and nutrients to plant materials with the receptacle. A dispensing bottle provides a metered discharge of fluid into the reservoir, thus extending the maintenance intervals required. The receptacle is releasibly joined to the base to allow cleaning of the plant and/or soilless medium.

Yet Still Another Example, U.S. Pat. No. 5,454,187 to Wasserman teaches a plant tender that delivers light to the foliage and water and nutrients to the roots of a plant growing in a container and embedded in an anchoring medium contained in the container. The plant tender has an armature positioned adjacent to the plant and formed with a conduit for electrical power. A reservoir is provided in physical contact with the container, armature, or anchoring medium. The reservoir supplies water and nutrients to the roots. An artificial light source is supported by the armature and irradiates the foliage. A controller establishes a duty cycle of the light source and controls both the duty cycle and the delivery of water and nutrients. In certain embodiments, the positions of the plants and lights can be adjusted, and fish are grown in symbiotic relation to the plants.

Finally, Still Yet Another Example, U.S. Pat. No. 5,478,039 to Wright teaches an overhead swivel hanging apparatus consisting of a mount and a support, i.e. a grab. When assembled the apparatus is utilized to hang pendant objects, such as a plant or a bird cage, from a ceiling or the like. The mount is comprised of a base, a cross brace, a connective means, an ornamental shell, a pendant leg, and a spherical bearing cast as a single piece. The support, mill stamped from tensile steel as a single piece, is an C-shaped hook with a widened U-shaped grab on the inferior aspect. On the superior aspect of the support is a slot with a flange which narrows posterior into keeper tabs. The keeper tabs are narrower than the slot which is wider than the leg. The internal surface has a concavity bisected by the slot which facilitates a ball and socket integration with the bearing. To connect the support to the mount, place the flange end against the pendant leg and move it laterally until past the keeper tabs thus preventing accidental uncoupling. The grab has a larger internal dimension at the top than at the bottom. Placement of the pendant object into the grab locks it into place through weight, friction, and interlocking torsion between the two pieces. Such an arrangement of components increases the rotational coefficiency by means of a ball and socket integration and the interlocking torsion on the grab.

It is apparent that numerous innovations for rotatable display devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

Accordingly An Object of the present invention is to provide a rotating display device that avoids the disadvantages of the prior art.

Another Object of the present invention is to provide a rotating display device that is simple and inexpensive to manufacture.

Still Another Object of the present invention is to provide a rotating display device that is simple to use.

Briefly Stated, Yet Another Object of the present invention is to provide a rotatable display device that is suspendable from a ceiling and allows a planter to be rotatably suspendable therefrom. The device includes a shallow and bowl-like lower housing, a shallow and inverted bowl-like upper housing that is replaceably attached to the shallow and bowl-like lower housing, a top hanger assembly that extends upwardly from the shallow and inverted bowl-like upper housing and suspends the rotatable display device from the ceiling and provides a means for grabbing the shallow and inverted bowl-like upper housing when the shallow and inverted bowl-like upper housing is to be removed from the shallow and bowl-like lower housing, a rotatable plate that is contained in, and rotatable relative to, one of the shallow and bowl-like lower housing and the shallow and inverted bowl-like upper housing, a bearing assembly that rotatably connects the rotatable plate to the other of the one of the shallow and bowl-like. like lower housing and the shallow and inverted bowl-like upper housing, a large and horizontally-oriented driven gear that is fixedly attached to, for rotation with, the rotatable plate, a bottom hanger assembly that extends downwardly from, and rotates with, one of the rotatable plate and the large and horizontally-oriented driven gear for rotatably suspending the planter therefrom, a motor contained in the other of the one of the shallow and bowl-like lower housing and the shallow and inverted bowl-like upper housing for rotating the rotatable plate, a motor is shaft that extends from the motor, a small and horizontally-oriented motor driver gear that is fixedly attached to the motor shaft for rotation therewith and is contained in the shallow and bowl-like lower housing wherein the small and horizontally-oriented motor driver gear is smaller than, and is rotatably operatively connected to, the large and horizontally-oriented bottom hanger driven gear, so that when the motor shaft rotates, the small and horizontally-oriented motor driver gear rotates, which in turn rotates the large and horizontally-oriented driven gear, which in turn rotates the rotatable plate and the bottom hanger assembly which is suspended from the one of the rotatable plate and the large and horizontally-oriented driven gear, and which in turn rotates the planter suspendable therefrom.

The novel features which are considered characteristic of the present invention are set forth in the appended claims. The invention itself, however, both as to its construction and its method of operation, together with additional objects and always thereof, will be best understood from the following description of the specific embodiments when read and understood in connection with the accompanying drawing.

DESCRIPTION OF THE DRAWING

The figures on the drawing are briefly described as follows:

FIG. 1 is a diagrammatic side elevational view of a preferred embodiment of the present invention suspended from a ceiling at one height and having a planter suspended therefrom at one height and being rotated;

FIG. 2 is a diagrammatic side elevational view of the preferred embodiment of the present invention shown in FIG. 1 and being suspended from a ceiling at another height and having the planter suspended therefrom at another height and being rotated;

FIG. 3 is an enlarged diagrammatic perspective view of the area generally enclosed by the dotted ellipse identified by arrow 3 in FIG. 1;

FIG. 4 is an enlarged diagrammatic perspective view with parts broken away and in partial section of the preferred embodiment of the present invention taken generally in the direction of arrow 4 in FIG. 3;

FIG. 5 is a diagrammatic cross sectional view taken on line 5—5 in FIG. 4 illustrating the gear train;

FIG. 6 is a diagrammatic perspective view taken generally in the direction of arrow 6 in FIG. 4 illustrating the thrust bearing assembly;

FIG. 7 is an enlarged diagrammatic cross sectional view with parts broken away of the area identified generally by arrow 7 in FIG. 4 illustrating the radially inwardly tapering of the opening in the lower housing for the bottom hanger suspension ring assembly;

FIG. 8 is a diagrammatic side elevational view with parts broken away taken generally in the direction of arrow 8 in FIG. 4 illustrating the bottom hanger assembly in the retracted position;

FIG. 9 is a diagrammatic enlarged top plan view with parts broken away taken generally in the direction of arrow 9 in FIG. 8 illustrating the stop assembly for the bottom hanger assembly;

FIG. 10 is a diagrammatic side elevational view of a first alternate embodiment of the present invention having a replaceably mounted top housing and containing a rotating disk with a bottom suspension ring assembly fixedly attached thereto and being recessed in a bottom housing for allowing the present invention to have an item rotatively suspended therefrom with the option of resting the present invention on a surface and rotatively supporting an object thereon by removing the top housing;

FIG. 11 is a diagrammatic side elevational view of a second alternate embodiment of the present invention similar to that of the first alternate embodiment, except that the top and bottom hanger assemblies are pivotally mounted;

FIG. 12 is an enlarged diagrammatic cross sectional view with parts broken away taken generally in the direction of arrow 12 in FIG. 11 illustrating the top hanger assembly in the retracted position;

FIG. 13 is a diagrammatic side elevational view of the first alternate embodiment of the present invention resting on a table and having items rotatively resting thereon and with an optional item rotatively suspended therefrom through the table top;

Figure 14:
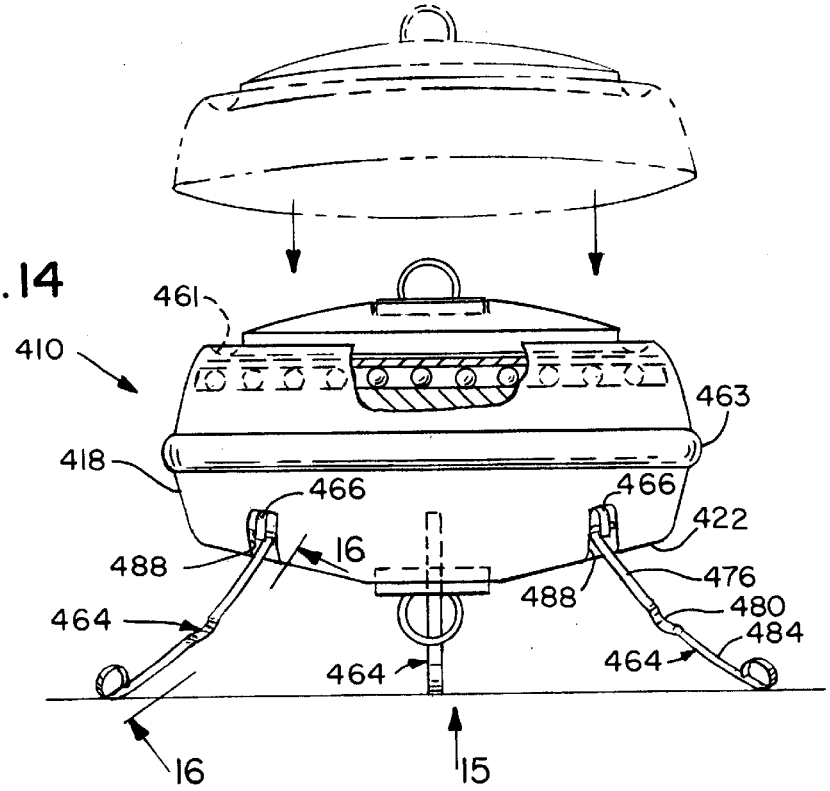
FIG. 14 is a diagrammatic side elevational view of a third alternate embodiment of the present invention with clasps utilized to hold the top housing to the bottom housing that are pivoted downwardly from the bottom housing and function as legs.

List OF REFERENCE NUMERALS UTILIZED IN THE DRAWING

Preferred Embodiment

10 rotating display device of the present invention
12 ceiling

14 planter
16 shallow and bowl-like lower housing
18 lower housing circular-shaped and downwardly tapering side wall
20 lower housing side wall lower edge
21 lower housing side wall upper edge
22 lower housing circular-shaped and slightly downwardly tapering bottom
24 lower housing bottom centrally disposed throughbore
26 lower housing bottom throughbore radially-inwardly tapering perimeter
27 lower housing bottom throughbore perimeter outwardly diverging upper edge
28 shallow dish-like rotating plate
29 lower housing open top
30 rotating plate circular-shaped and downwardly tapering side wall
31 lower housing bottom throughbore perimeter outwardly diverging lower edge
32 plate wall lower edge
34 rotating plate flat and circular-shaped bottom
36 rotating plate bottom circular-shaped perimeter
38 rotating plate bottom flat upper surface
39 rotating plate bottom flat lower surface
40 rotating plate bottom center
42 circular-shaped thrust bearing assembly
44 thrust bearing assembly circular-shaped lower race
46 thrust bearing assembly circular-shaped upper race
48 large and horizontally-oriented bottom hanger driven gear
49 large fixed gear center
50 slender, elongated, vertically-oriented, and cylindrically-shaped shaft
52 replaceably mounted bottom hanger assembly
54 bottom hanger assembly cord
56 cylindrically-shaped cord housing
58 shallow and inverted bowl-like upper housing
60 upper housing circular-shaped and upwardly tapering side wall
62 upper housing side wall lower edge
63 upper housing side wall lower edge circumferentially disposed lip
64 upper housing side wall upper edge
66 upper housing flat and circular-shaped bottom
68 upper housing bottom centrally disposed throughbore
69 an upper housing bottom upper surface
70 upper housing circular-shaped and upwardly tapering top
72 upper housing top centrally disposed collar
74 top hanger assembly
76 top hanger assembly thin and circular-shaped disk
78 top hanger assembly ring
80 motor
82 pair of parallel, spaced-apart, and rectangular-parallelepiped-shaped battery holders
83 pair of battery holder parallel, spaced-apart, and rectangular-parallelepiped-shaped walls
84 motor shaft
86 motor shaft throughbore
87 motor shaft distal end
88 small and horizontally-oriented motor driver gear
90 vertically oriented idler gear shaft
92 large and horizontally-oriented idler gear
94 small and horizontally-oriented idler gear
96 bottom hanger assembly thin and circular-shaped disk
98 bottom hanger assembly disk upper surface
100 bottom hanger disk upper surface center
102 bottom hanger assembly disk lower surface
104 bottom hanger assembly disk circular-shaped periphery
106 bottom hanger assembly disk upper surface pair of diametrically-opposed and radially-outwardly-extending tabs
108 bottom hanger assembly disk lower surface pair of diametrically-opposed and radially-outwardly-extending tabs
110 bottom hanger assembly ring
112 lower housing bottom throughbore perimeter pair of diametrically-opposed and radially-outwardly-extending throughslots
114 bottom hanger assembly pair of vertically-oriented and diametrically opposed stop pins First Alternate Embodiment

210 rotating display device of the present invention
218 lower housing circular-cylindrically-shaped side wall
220 lower housing side wall lower edge
221 lower housing side wall upper edge
22 lower housing flat, horizontally-oriented, and circular-shaped bottom
224 lower housing bottom centrally disposed throughbore
226 lower housing bottom throughbore perimeter
227 lower housing bottom throughbore perimeter hollow, upwardly-extending, and cylindrically-shaped collar
229 lower housing circular-shaped top
230 lower housing top flat and horizontally-oriented outer peripheral ring
232 lower housing outer peripheral ring inner peripheral edge
234 lower housing top intermediate collar
236 lower housing intermediate collar lower edge
238 lower housing top horizontally-oriented inner peripheral ring
240 lower housing top inner peripheral ring inner edge
242 lower housing top centrally disposed and circular-shaped throughbore
243 lower housing top inner peripheral ring upper surface
244 lower housing top inner peripheral ring upper surface circumferentially-disposed recess
245 bearings
246 shallow and inverted bowl-like upper housing
248 upper housing circular-shaped and upwardly tapering side wall
250 upper housing side wall lower edge
252 upper housing side wall upper edge
254 upper housing flat and ring-shaped bottom
256 upper housing flat and ring-shaped bottom inner peripheral edge
258 upper housing bottom centrally-disposed and circular-shaped throughbore
260 upper housing circular-shaped and upwardly tapering top
261 upper housing top center
262 upper housing top centrally-disposed and upwardly-extending upper hanger assembly
264 upper housing top upper hanger assembly lateral throughbore
266 horizontally-oriented and circular-shaped rotating disk
267 rotating disk side wall
268 rotating disk flat lower surface
270 rotating disk lower surface circumferentially-disposed recess
272 large and horizontally-oriented bottom hanger driven gear
274 bottom hanger driven gear lower surface
276 bottom hanger driven gear lower surface center

278 lower hanger assembly
280 lower hanger assembly lateral throughbore
282 motor
284 motor shaft
286 motor shaft distal end
288 small and horizontally-oriented motor driver gear
290 pair of battery holders
292 batteries Second Alternate Embodiment

310 rotating display device of the present invention
360 upper housing flat and circular-shaped top
362 upper housing top centrally disposed and pivotally-mounted upper hanger assembly
364 upper housing top centrally-disposed and vertically-oriented recess
366 lower housing bottom centrally disposed and pivotally-mounted lower hanger assembly
368 upper housing top upper hanger assembly pivot support
370 upper housing top upper hanger assembly D-ring Third Alternate Embodiment

410 rotating display device of the present invention
418 lower housing circular-shaped and downwardly tapering side wall
422 lower housing circular-shaped and slightly downwardly tapering bottom
461 upper housing top circumferentially-disposed recess
463 upper housing side wall lower edge circumferentially-disposed lip
464 three pivotally-mounted and springy legs
466 leg slender and inverted U-shaped mounting portion
468 leg mounting portion slender innermost leg
470 leg mounting portion innermost leg end
472 leg mounting portion slender outermost leg
474 leg mounting portion outermost leg end
476 leg slender, elongated, and outwardly diverging upper portion
478 leg upper portion end
480 leg slender and concavo-convex-shaped intermediate portion
482 leg intermediate portion end
484 leg slender, elongated, and outwardly diverging lower portion
486 leg lower portion outwardly-extending ring
488 lower housing three equally spaced-apart, specifically-configured, and radially-oriented recesses
490 recess flat and inwardly-slightly-downwardly-extending outer upper wall
492 recess flat and vertically-oriented outer side wall
494 recess flat and horizontally-oriented inner upper wall
496 recess flat and vertically-oriented inner side wall
498 recess horizontally-oriented pivot pin
498 horizontally-oriented pivot pin Power Circuit For The Preferred And Alternate Embodiments

500 power circuit
502 power circuit power supply
504 power circuit power supply positive terminal
506 power circuit power supply negative terminal
508 power circuit timer
510 power circuit photocell gate
512 power circuit photocell
514 power circuit timer override switch

DESCRIPTION OF THE PREFERRED EMBODIMENT

Referring now to the figures in which like numerals indicate like parts, and particularly to FIGS. 1–3, which are a diagrammatic side elevational view of a preferred embodiment of the present invention suspended from a ceiling at one height and having a planter suspended therefrom at one height and being rotated, a diagrammatic side elevational view of the preferred embodiment of the present invention shown in FIG. 1 and being suspended from a ceiling at another height and having the planter suspended therefrom at another height and being rotated, and an enlarged diagrammatic perspective view of the area generally enclosed by the dotted ellipse identified by arrow 3 in FIG. 1, respectively, the rotating display device of the present invention is shown generally at 10 being suspended from a ceiling 12 and having a planter 14 suspended therefrom.

The configuration of the rotating display device 10 can best be seen in FIGS. 4–7, which are an enlarged diagrammatic perspective view with parts broken away and in partial section of the preferred embodiment of the present invention taken generally in the direction of arrow 4 in FIG. 3, a diagrammatic cross sectional view taken on line 5—5 in FIG. 4 illustrating the gear train, a diagrammatic perspective view taken generally in the direction of arrow 6 in FIG. 4 illustrating the thrust bearing assembly, and an enlarged diagrammatic cross sectional view with parts broken away of the area identified generally by arrow 7 in FIG. 4 illustrating the radially inwardly tapering of the opening in the lower housing for the lower suspension ring assembly, respectively, and a3 such will be discussed with reference thereto.

The rotating display device 10 includes a shallow and bowl-like lower housing 16.

The shallow and bowl-like lower housing 16 has a lower housing circular-shaped and downwardly tapering side wall 18 with a lower housing side wall lower edge 20 and a lower housing side wall upper edge 21.

The shallow and bowl-like lower housing 16 further has a lower housing circular-shaped and slightly downwardly tapering bottom 22 that extends downwardly from, and is integral with, the lower housing side wall lower edge 20 of the lower housing circular-shaped and downwardly tapering side wall 18 of the shallow and bowl-like lower housing 16 and has a lower housing bottom centrally disposed throughbore 24 that extends vertically therethrough and is defined by a lower housing bottom throughbore radially-inwardly tapering perimeter 26 with a lower housing bottom throughbore perimeter outwardly diverging upper edge 27 and a lower housing bottom throughbore perimeter outwardly diverging lower edge 31.

The shallow and bowl-like lower housing 16 further has a lower housing open top 29 defined by the lower housing side wall upper edge 21 of the lower housing circular-shaped and downwardly tapering side wall 18 of the shallow and bowl-like lower housing 16.

The rotating display device 10 further includes a shallow dish-like rotating plate 28 that is preferably 4.1527" in diameter and is contained in, and rotates relative to, the shallow and bowl-like lower housing 16.

The shallow dish-like rotating plate 28 has a rotating plate circular-shaped and downwardly tapering side wall 30 that is inward of, and in close proximity to, the lower housing circular-shaped and downwardly tapering side wall 18 of the shallow and bowl-like lower housing 16 and has a plate wall lower edge 32.

The shallow dish-like rotating plate 28 further has a rotating plate flat and circular-shaped bottom 34 that extends across, and is integral with, the plate wall lower edge 32 of the shallow dish-like rotating plate 28, and is spaced above the lower housing circular-shaped and slightly downwardly tapering bottom 22 of the shallow and bowl-like lower housing 16.

The rotating plate flat and circular-shaped bottom 34 of the shallow dish-like rotating plate 28 has a rotating plate bottom circular-shaped perimeter 36, a rotating plate bottom flat upper surface 38, a rotating plate bottom flat lower surface 39, and a rotating plate bottom center 40 that is in vertical alignment with the lower housing bottom centrally disposed throughbore 24 in the lower housing circular-shaped and slightly downwardly tapering bottom 22 of the shallow and bowl-like lower housing 16.

The rotating display device 10 further includes a circular-shaped thrust bearing assembly 42 that has a thrust bearing assembly circular-shaped lower race 44 that is disposed on the rotating plate bottom flat upper surface 38 of the rotating plate flat and circular-shaped bottom 34 of the shallow dish-like rotating plate 28, at the rotating plate bottom circular-shaped perimeter 36 of the rotating plate flat and circular-shaped bottom 34 of the shallow dish-like rotating plate 28, and a thrust bearing assembly circular-shaped upper race 46 that is disposed above the thrust bearing assembly circular-shaped lower race 44 of the circular-shaped thrust bearing assembly 42.

The rotating display device 10 further includes a large and horizontally-oriented bottom hanger driven gear 48 that is preferably 1.71" in diameter, is fixedly attached to the rotating plate bottom flat upper surface 38 of the rotating plate flat and circular-shaped bottom 34 of the shallow dish-like rotating plate 28, at the rotating plate bottom center 40 of the rotating plate flat and circular-shaped bottom 34 of the shallow dish-like rotating plate 28, rotates with the shallow dish-like rotating plate 28, has a large fixed gear center 49, and is contained in the shallow and bowl-like lower housing 16.

The rotating display device 10 further includes a slender, elongated, vertically-oriented, and cylindrically-shaped shaft 50 that is fixedly attached to, extends perpendicularly vertically upwardly from, the large fixed gear center 49 of the large and horizontally-oriented bottom hanger driven gear 48, and rotates with the large and horizontally-oriented bottom hanger driven gear 48.

The rotating display device 10 further includes a replaceably mounted bottom hanger assembly 52 that is replaceably securable to the lower housing circular-shaped and slightly downwardly tapering bottom 22 of the shallow and bowl-like lower housing 16, selectively enters and leaves the lower housing bottom centrally disposed throughbore 24 in the lower housing circular-shaped and slightly downwardly tapering bottom 22 of the shallow and bowl-like lower housing 16, provides the vehicle for which the planter 14 is suspended from the rotating display device 10, and whose structural details will be discussed, infra.

The replaceably mounted bottom hanger assembly 52 has an extended position and a retracted position relative to the lower housing circular-shaped and slightly downwardly tapering bottom 22.

The replaceably mounted bottom hanger assembly 52 is suspended from the rotating plate bottom flat lower surface 39, at the rotating plate bottom center 40 of the rotating plate flat and circular-shaped bottom 34 of the shallow dish-like rotating plate 28, by a bottom hanger assembly cord 54.

The bottom hanger assembly cord 54 passes vertically and freely through the lower housing bottom centrally disposed throughbore 24 in the lower housing circular-shaped and slightly downwardly tapering bottom 22 of the shallow and bowl-like lower housing 16, and rotates with the shallow dish-like rotating plate 28.

The rotating display device 10 further includes a cylindrically-shaped cord housing 56 that is fixedly attached to the rotating plate bottom flat lower surface 39, at the rotating plate bottom center 4u of the rotating plate flat and circular-shaped bottom 34 of the shallow dish-like rotating plate 28, and rotates with the shallow dish-like rotating plate 28.

The cylindrically-shaped cord housing 56 houses the bottom hanger assembly cord 54 and a spiral retraction spring (not shown) that is operatively connected to the bottom hanger assembly cord 54 for retracting the bottom hanger assembly cord 54 into the cylindrically-shaped cord housing 56 when the load is removed from the replaceably mounted bottom hanger assembly 52.

The rotating display device 10 includes a shallow and inverted bowl-like upper housing 58.

The shallow and inverted bowl-like upper housing 58 has an upper housing circular-shaped and upwardly tapering side wall 60 with an upper housing side wall lower edge 62 that has an upper housing side wall lower edge circumferentially-disposed lip 63 extending outwardly therearound and an upper housing side wall upper edge 64.

The shallow and inverted bowl-like upper housing 58 further has an upper housing flat and circular-shaped bottom 66 that extends across the upper housing side wall lower edge 62 of the upper housing circular-shaped and upwardly tapering side wall 60 the shallow and inverted bowl-like upper housing 58 and has an upper housing bottom centrally disposed throughbore 68 that extends vertically therethrough and an upper housing bottom upper surface 69.

The shallow and inverted bowl-like upper housing 58 further has an upper housing circular-shaped and upwardly tapering top 70 that extends across the upper housing side wall upper edge 64 of the upper housing circular-shaped and upwardly tapering side wall 60 of the shallow and inverted bowl-like upper housing 58 and has an upper housing top centrally disposed collar 72 that extends vertically downwardly thereform and is vertically aligned with the upper housing bottom centrally disposed throughbore 68 in the upper housing flat and circular-shaped bottom 66 of the shallow and inverted bowl-like upper housing 58.

The shallow and inverted bowl-like upper housing 58 is replaceably mounted to the shallow and bowl-like lower housing 16, with the upper housing side wall lower edge 62 of the upper housing circular-shaped and upwardly tapering side wall 60 of the shallow and inverted bowl-like upper housing 58 abutting against the lower housing side wall upper edge 21 of the lower housing circular-shaped and downwardly tapering side wall 18 of the shallow and bowl-like lower housing 16, with the upper housing flat and circular-shaped bottom 66 of the shallow and inverted bowl-like upper housing 58 abutting against the thrust bearing assembly circular-shaped upper race 46 of the circular-shaped thrust bearing assembly 42, and with the slender, elongated, vertically-oriented and cylindrically-shaped shaft 50 extending perpendicularly vertically and rotatively through the upper housing bottom centrally disposed throughbore 68 in the upper housing flat and circular-shaped bottom 66 of the shallow and inverted bowl-like upper housing 58 and rotatively into the upper housing top centrally disposed collar of the upper housing circular-shaped and upwardly tapering top 70 of the shallow and inverted bowl-like upper housing 58.

The rotating display device 10 further includes a top hanger assembly 74 that has a top hanger assembly thin and circular-shaped disk 76 that is disposed on the upper housing circular-shaped and upwardly tapering top 70 of the shallow and inverted bowl-like upper housing 58, opposite to the upper housing top centrally disposed collar 72.

The top hanger assembly 74 further has a top hanger assembly ring 78 that extends vertically upwardly from the top hanger assembly thin and circular-shaped disk 76 of the top hanger assembly 74 and provides the vehicle for which the rotating display device 10 is suspended from the ceiling 12.

The rotating display device 10 further includes a motor 80 that is contained in the shallow and inverted bowl-like upper housing 58 and is disposed on the upper housing bottom upper surface 69 of the upper housing flat and circular-shaped bottom 66 of the shallow and inverted bowl-like upper housing 58, at the upper housing side wall lower edge 62 of the upper housing circular-shaped and upwardly tapering side wall 60 of the shallow inverted bowl-like upper housing 58.

The rotating display device 10 further includes a pair of parallel, spaced-apart, and rectangular-parallelepiped-shaped battery holders 82 that are contained in the shallow and inverted bowl-like upper housing 58, on the upper housing bottom upper surface 69 of the upper housing flat and circular-shaped bottom 66 of the shallow and inverted bowl-like upper housing 58, and straddle the slender, elongated, vertically-oriented, and cylindrically-shaped shaft 50.

Each holder of the pair of parallel, spaced-apart, and rectangular-parallelepiped-shaped battery holders 82 is formed by a pair of battery holder parallel, spaced-apart, and rectangular-parallelepiped-shaped walls 83 that extend perpendicularly vertically upwardly from, and along chords of, the upper housing bottom upper surface 69 of the upper housing flat and circular-shaped bottom 66 of the shallow and inverted bowl-like upper housing 58.

An outermost wall of the one pair of battery holder parallel, spaced-apart, and rectangular-parallelepiped-shaped walls 83 of one holder of the pair of parallel, spaced-apart, and rectangular-parallelepiped-shaped battery holders 82 together with the upper housing circular-shaped and upwardly tapering side wall 60 of the shallow and inverted bowl-like upper housing 58 define a space in which the motor 80 is mounted.

Each innermost wall of the one pair of battery holder parallel, spaced-apart, and rectangular-parallelepiped-shaped walls 83 of the pair of parallel, spaced-apart, and rectangular-parallelepiped-shaped battery holders 82 straddle the upper housing bottom centrally disposed throughbore 68 in the upper housing flat and circular-shaped bottom 66 of the shallow and inverted bowl-like upper housing 58, in close proximity thereto.

The rotating display device 10 further includes a motor shaft 84 that extends perpendicularly vertically downwardly from the motor 80, rotatively through a motor shaft throughbore 86 in the upper housing flat and circular-shaped bottom 66 of the shallow and inverted bowl-like upper housing 58, and into the shallow and bowl-like lower housing 16 where it terminates in a motor shaft distal end 87.

The rotating display device 10 further includes a small and horizontally-oriented motor driver gear 88 that is preferably 0.188" in diameter, is fixedly attached to the motor shaft distal end 87 of the motor shaft 84, rotates with the motor shaft 84, is smaller than the large and horizontally-oriented bottom hanger driven gear 48, is contained in the shallow and bowl-like lower housing 16 above, and parallel to, the large and horizontally-oriented bottom hanger driven gear 48.

The rotating display device 10 further includes a vertically oriented idler gear shaft 90 that extends perpendicularly vertically downwardly and rotatively from the upper housing flat and circular-shaped bottom 66 of the shallow and inverted bowl-like upper housing 58, on a radius from the motor shaft 84 to the slender, elongated, vertically-oriented, and cylindrically-shaped shaft 50, to the rotating plate bottom flat upper surface 38 of the rotating plate flat and circular-shaped bottom 34 of the shallow dish-like rotating plate 28.

The rotating display device 10 further includes a large and horizontally-oriented idler gear 92 that is fixedly attached to for rotation with the vertically oriented idler gear shaft 90.

The large and horizontally-oriented idler gear 92 is coplanar with, and rotatively engages, the small and horizontally-oriented motor driver gear 88, is identical to the large and horizontally-oriented bottom hanger driven gear 48, and is contained in the shallow and bowl-like lower housing 16.

The rotating display device 10 further includes a small and horizontally-oriented idler gear 94 that is preferably 0.38" in diameter, is fixedly attached to for rotation with the vertically oriented idler gear shaft 90, is below and parallel to the large and horizontally-oriented idler gear 92, is coplanar with, and rotatively engages the large and horizontally-oriented bottom hanger driven gear 48, and is contained in the shallow and bowl-like lower housing 16.

When the batteries (not shown) held in the pair of parallel, spaced-apart, and rectangular-parallelepiped-shaped battery holders 82 power the motor 80 and rotate the motor shaft 86, the small and horizontally-oriented motor driver gear 88 rotates, which in turn rotates the large and horizontally-oriented idler gear 92, which in turn rotates the vertically oriented idler gear shaft 90, which in turn rotates the small and horizontally-oriented idler gear 94, which in turn rotates the large and horizontally-oriented bottom hanger driven gear 48, which in turn rotates the shallow dish-like rotating plate 28, and which in turn ultimately rotates the replaceably mounted bottom hanger assembly 52.

The configuration of the replaceably mounted bottom hanger assembly 52 can best be seen in FIGS. 4, 8, and 9, which are again an enlarged diagrammatic perspective view with parts broken away and in partial section of the preferred embodiment of the present invention taken generally in the direction of arrow 4 in FIG. 3, a diagrammatic side elevational view with parts broken away taken generally in the direction of arrow 8 in FIG. 4 illustrating the lower suspension ring assembly in the retracted position, and a diagrammatic enlarged top plan view with parts broken away taken generally in the direction of arrow 9 in FIG. 8 illustrating the stop assembly for the lower suspension ring assembly, respectively, and as such will be discussed with reference thereto.

The replaceably mounted bottom hanger assembly 52 includes a bottom hanger assembly thin and circular-shaped disk 96 that selectively opens and closes the lower housing bottom centrally disposed throughbore 24 in the lower housing circular-shaped and slightly downwardly tapering bottom 22 of the shallow and bowl-like lower housing 16, while being rotative therein.

The bottom hanger assembly thin and circular-shaped disk 96 of the replaceably mounted bottom hanger assembly 52 has a bottom hanger assembly disk upper surface 98 with a bottom hanger disk upper surface center 100 to which the bottom hanger assembly cord 54 is attached, a bottom hanger assembly disk lower surface 102, and a bottom hanger assembly disk circular-shaped periphery 104.

The replaceably mounted bottom hanger assembly 52 further includes a bottom hanger assembly disk upper surface pair of diametrically-opposed and radially-outwardly-extending tabs 106 that extend radially outwardly from the bottom hanger assembly disk upper surface 98 of the bottom hanger assembly thin and circular-shaped disk 96 of the replaceably mounted bottom hanger assembly 52, at the bottom hanger assembly disk circular-shaped periphery 104 of the bottom hanger assembly thin and circular-shaped disk 96 of the replaceably mounted bottom hanger assembly 52, and selectively engage with, and disengage from, the lower housing bottom throughbore perimeter outwardly diverging upper edge 27 of the lower housing bottom throughbore radially-inwardly tapering perimeter 26 of the lower housing bottom centrally disposed throughbore 24 in the lower housing circular-shaped and slightly downwardly tapering bottom 22 of the shallow and bowl-like lower housing 16.

The replaceably mounted bottom hanger assembly 52 further includes a bottom hanger assembly disk lower surface pair of diametrically-opposed and radially-outwardly-extending tabs 108 that extend radially outwardly from the bottom hanger assembly disk lower surface 102 of the bottom hanger assembly thin and circular-shaped disk 96 of the replaceably mounted bottom hanger assembly 52, at the bottom hanger assembly disk circular-shaped periphery 104 of the bottom hanger assembly thin and circular-shaped disk 96 of the replaceably mounted bottom hanger assembly 52, intermediate the bottom hanger assembly disk upper surface pair of diametrically-opposed and radially-outwardly-extending tabs 106 of the replaceably mounted bottom hanger assembly 52, and selectively engage with, and disengage from, the lower housing bottom throughbore perimeter outwardly diverging lower edge 31 of the lower housing bottom throughbore radially-inwardly tapering perimeter 26 of the lower housing bottom centrally disposed throughbore 24 in the lower housing circular-shaped and slightly downwardly tapering bottom 22 of the shallow and bowl-like lower housing 16.

The replaceably mounted bottom hanger assembly 52 further includes a bottom hanger assembly ring 110 that extends perpendicularly vertically downwardly from the bottom hanger assembly disk lower surface 102 of the bottom hanger assembly thin and circular-shaped disk 96 of the replaceably mounted bottom hanger assembly 52.

The replaceably mounted bottom hanger assembly 52 further includes the lower housing bottom throughbore radially-inwardly tapering perimeter 26 of the lower housing bottom centrally disposed throughbore 24 in the lower housing circular-shaped and slightly downwardly tapering bottom 22 of the shallow and bowl-like lower housing 16 having a lower housing bottom throughbore perimeter pair of diametrically-opposed and radially-outwardly-extending throughslots 112 that open into the lower housing bottom centrally disposed throughbore 24 in the lower housing circular-shaped and slightly downwardly tapering bottom 22 of the shallow and bowl-like lower housing 16 and have a configuration similar to that of the bottom hanger assembly disk upper surface pair of diametrically-opposed and radially-outwardly-extending tabs 106 of the replaceably mounted bottom hanger assembly 52 so as to allow the bottom hanger assembly disk upper surface pair of diametrically-opposed and radially-outwardly-extending tabs 106 of the replaceably mounted bottom hanger assembly 52 to selectively enter therein and leave therefrom.

The replaceably mounted bottom hanger assembly 52 further includes a bottom hanger assembly pair of vertically-oriented and diametrically opposed stop pins 114 that extend vertically upwardly from the lower housing bottom throughbore perimeter outwardly diverging upper edge 27 of the lower housing bottom throughbore radially-inwardly tapering perimeter 26 of the lower housing bottom centrally disposed throughbore 24 in the lower housing circular-shaped and slightly downwardly tapering bottom 22 of the shallow and bowl-like lower housing 16, intermediate the lower housing bottom throughbore perimeter pair of diametrically-opposed and radially-outwardly-extending throughslots 112 in the lower housing bottom throughbore radially-inwardly tapering perimeter 26 of the lower housing bottom centrally disposed throughbore 24 in the lower housing circular-shaped and slightly downwardly tapering bottom 22 of the shallow and bowl-like lower housing 16.

The bottom hanger assembly pair of vertically-oriented and diametrically opposed stop pins 114 of the replaceably mounted bottom hanger assembly 52 function as a stop for the rotation of the replaceably mounted bottom hanger assembly 52 by being abuttable by the bottom hanger assembly disk upper surface pair of diametrically-opposed and radially-outwardly-extending tabs 106 of the replaceably mounted bottom hanger assembly 52.

The method of allowing the replaceably mounted bottom hanger assembly 52 to achieve and maintain the retracted position when it is in the extended position will be discussed, infra.

Step 1: Align the bottom hanger assembly disk upper surface pair of diametrically-opposed and radially-outwardly-extending tabs 106 of the replaceably mounted bottom hanger assembly 52 with the lower housing bottom throughbore perimeter pair of diametrically-opposed and radially-outwardly-extending throughslots 112 in the lower housing bottom throughbore radially-inwardly tapering perimeter 26 of the lower housing bottom centrally disposed throughbore 24 in the lower housing circular-shaped and slightly downwardly tapering bottom 22 of the shallow and bowl-like lower housing 16.

Step 2: Pass the bottom hanger assembly disk upper surface pair of diametrically-opposed and radially-outwardly-extending extending tabs 106 of the replaceably mounted bottom hanger assembly 52 upwardly through the lower housing bottom throughbore perimeter pair of diametrically-opposed and radially-outwardly-extending throughslots 112 in the lower housing bottom throughbore radially-inwardly tapering perimeter 26 of the lower housing bottom centrally disposed throughbore 24 in the lower housing circular-shaped and slightly downwardly tapering bottom 22 of the shallow and bowl-like lower housing 16, with the bottom hanger assembly disk lower surface pair of diametrically-opposed and radially-outwardly-extending tabs 108 of the replaceably mounted bottom hanger assembly 52 abutting against the lower housing bottom throughbore perimeter outwardly diverging lower edge 31 of the lower housing bottom throughbore radially-inwardly tapering perimeter 26 of the lower housing bottom centrally disposed throughbore 24 in the lower housing circular-shaped and slightly downwardly tapering bottom 22 of the shallow and bowl-like lower housing 16.

Step 3: Turn the replaceably mounted bottom hanger assembly 52 clockwise, by use of the bottom hanger assembly ring 110 of the replaceably mounted bottom hanger assembly 52, with the bottom hanger assembly disk upper surface pair of diametrically-opposed and radially-outwardly-extending tabs 106 of the replaceably mounted bottom hanger assembly 52 abutting against the lower housing bottom throughbore perimeter outwardly diverging upper edge 27 of the lower housing bottom throughbore radially-inwardly tapering perimeter 26 of the lower housing bottom centrally disposed throughbore 24 in the lower housing circular-shaped and slightly downwardly tapering bottom 22 of the shallow and bowl-like lower housing 16, until the bottom hanger assembly disk upper surface pair of diametrically-opposed and radially-outwardly-extending tabs 106 of the replaceably mounted bottom hanger assembly 52 abut against the bottom hanger assembly pair of vertically-oriented and diametrically opposed stop pins 114.

The method of allowing the replaceably mounted bottom hanger assembly 52 to achieve the extended position when it is in the retracted position will be discussed, infra.

Step 1: Turn the replaceably mounted bottom hanger assembly 52 counterclockwise, by use of the bottom hanger assembly ring 110 of the replaceably mounted bottom hanger assembly 52, until the bottom hanger assembly disk upper surface pair of diametrically-opposed and radially-outwardly-extending tabs 106 of the replaceably mounted bottom hanger assembly 52 align with the lower housing bottom throughbore perimeter pair of diametrically-opposed and radially-outwardly-extending throughslots 112 in the lower housing bottom throughbore radially-inwardly tapering perimeter 26 of the lower housing bottom centrally disposed throughbore 24 in the lower housing circular-shaped and slightly downwardly tapering bottom 22 of the shallow and bowl-like lower housing 16.

Step 2: Pull the replaceably mounted bottom hanger assembly 52 downwardly, by use of the bottom hanger assembly ring 110 of the replaceably mounted bottom hanger assembly 52, with the bottom hanger assembly disk upper surface pair of diametrically-opposed and radially-outwardly-extending tabs 106 of the replaceably mounted bottom hanger assembly 52 leaving the lower housing bottom throughbore perimeter pair of diametrically-opposed and radially-outwardly-extending throughslots 112 in the lower housing bottom throughbore radially-inwardly tapering perimeter 26 of the lower housing bottom centrally disposed throughbore 24 in the lower housing circular-shaped and slightly downwardly tapering bottom 22 of the shallow and bowl-like lower housing 16.

The configuration of the first alternate embodiment of a rotating display device 210 can best be seen in FIGS. 10 and 13, which are a diagrammatic side elevational view of a first alternate embodiment of the present invention having a replaceably mounted top housing and containing a rotating disk with a bottom hanger assembly fixedly attached thereto and being recessed in a bottom housing for allowing the present invention to have an item rotatively suspended therefrom with the option of resting the present invention on a surface and rotatively supporting an object thereon by removing the top housing, and a diagrammatic side elevational view of the first alternate embodiment of the present invention resting on a table and having items rotatively resting thereon and with an optional item rotatively suspended therefrom through the table top, respectively, and as such will be discussed with reference thereto.

The rotating display device 210 includes a shallow and bowl-like lower housing 216.

The shallow and bowl-like lower housing 216 has a lower housing circular-cylindrically-shaped side wall 218 with a lower housing side wall lower edge 220 and a lower housing side wall upper edge 221.

The shallow and bowl-like lower housing 216 further has a lower housing flat, horizontally-oriented, and circular-shaped bottom 222 that extends perpendicularly across, and is integral with, the lower housing side wall lower edge 220 of the lower housing circular-cylindrically-shaped side wall 218 of the shallow and bowl-like lower housing 216 and has a lower housing bottom centrally disposed throughbore 224 that extends vertically therethrough and which is defined by a lower housing bottom throughbore perimeter 226.

The shallow and bowl-like lower housing 216 further has a lower housing bottom throughbore perimeter hollow, upwardly-extending, and cylindrically-shaped collar 227 that extends perpendicularly vertically upwardly from, and is integral with, the lower housing bottom throughbore perimeter 226 of the lower housing bottom centrally disposed throughbore 224 in the lower housing flat, horizontally-oriented, and circular-shaped bottom 222 of the shallow and bowl-like lower housing 216, to a height less than that of the lower housing circular-cylindrically-shaped side wall 218 of the shallow and bowl-like lower housing 16.

The shallow and bowl-like lower housing 216 further has a lower housing circular-shaped top 229 that extends across the lower housing side wall upper edge 221 of the lower housing circular-cylindrically-shaped side wall 218 of the shallow and bowl-like lower housing 216.

The lower housing circular-shaped top 229 of the shallow and bowl-like lower housing 216 has a lower housing top flat and horizontally-oriented outer peripheral ring 230 that extends horizontally inwardly from, and is integral with, the lower housing side wall upper edge 221 of the lower housing circular-cylindrically-shaped side wall 218 of the shallow and bowl-like lower housing 216 and terminates in a lower housing outer peripheral ring inner peripheral edge 232.

The lower housing circular-shaped top 229 of the shallow and bowl-like lower housing 216 further has a lower housing top intermediate collar 234 that extends vertically downwardly from, and is integral with, the lower housing outer peripheral ring inner edge 232 of the lower housing top flat and horizontally-oriented outer peripheral ring 230 of the lower housing circular-shaped top 229 of the shallow and bowl-like lower housing 216 and terminates in a lower housing intermediate collar lower edge 236.

The lower housing circular-shaped top 229 of the shallow and bowl-like lower housing 216 further has a lower housing top horizontally-oriented inner peripheral ring 238 that extends horizontally inwardly from, and is integral with, the lower housing intermediate collar lower edge 236 of the lower housing top intermediate collar 234 of the lower housing circular-shaped top 229 of the shallow and bowl-like lower housing 216 and terminates in a lower housing top inner peripheral ring inner edge 240 that defines a lower housing top centrally disposed and circular-shaped throughbore 242.

The lower housing top horizontally-oriented inner peripheral ring 238 of the lower housing circular-shaped top 229 of the shallow and bowl-like lower housing 216 further has a lower housing top inner peripheral ring upper surface 243 with a lower housing top inner peripheral ring upper surface circumferentially-disposed recess 244 that extends completely and circumferentially therearound.

The rotating display device 210 further includes bearings 245 that are rotatively disposed in, and along, the lower housing top inner peripheral ring upper surface circumferentially-disposed recess 244 in the lower housing top inner peripheral ring per surface 243 of the lower housing top horizontally-oriented inner peripheral ring 238 of the lower housing circular-shaped top 229 of the shallow and bowl-like lower housing 216.

The rotating display device 210 further includes a shallow and inverted bowl-like upper housing 246 that is replaceably mounted to the shallow and bowl-like lower housing 216.

The shallow and inverted bowl-like upper housing 246 has an upper housing circular-shaped and upwardly tapering side wall 248 with an upper housing side wall lower edge 250 and an upper housing side wall upper edge 252.

The shallow and inverted bowl-like upper housing 246 further has an upper housing flat and ring-shaped bottom 254 that extends horizontally inwardly from the upper housing side wall lower edge 250 of the upper housing circular-shaped and upwardly tapering side wall 221 of the shallow and inverted bowl-like upper housing 246 and terminates in an upper housing flat and ring-shaped bottom inner peripheral edge 256 that defines an upper housing bottom centrally-disposed and circular-shaped throughbore 258.

The shallow and inverted bowl-like upper housing 246 further has an upper housing circular-shaped and upwardly tapering top 260 that extends across the upper housing side wall upper edge 252 of the upper housing circular-shaped and upwardly tapering side wall 248 of the shallow and inverted bowl-like upper housing 246 and has an upper housing top center 261 from which an upper housing top centrally-disposed and upwardly-extending upper hanger assembly 262 extends vertically upwardly from and which is fixedly attached thereto.

The upper housing top centrally disposed and upwardly extending upper hanger assembly 262 of the shallow and inverted bowl-like upper housing 246 provides a means for grabbing the shallow and inverted bowl-like upper housing 246 when the shallow and inverted bowl-like upper housing 246 is to be removed from the shallow and bowl-like lower housing 216.

The upper housing top centrally disposed and upwardly extending upper hanger assembly 262 of the shallow and inverted bowl-like upper housing 246 has an upper housing top upper hanger assembly lateral throughbore 264 that extends horizontally therethrough from which the rotating display device 210 is suspended from the ceiling 12.

The shallow and inverted bowl-like upper housing 246 is replaceably attached onto, and captures a part of, the shallow and bowl-like lower housing 216, with the upper housing bottom centrally-disposed throughbore 258 in the upper housing flat and ring-shaped bottom 254 of the shallow and inverted bowl-like upper housing 246 replaceably receiving the shallow and bowl-like lower housing 216, with the upper housing flat and ring-shaped bottom inner peripheral edge 256 of the upper housing flat and ring-shaped bottom 254 of the shallow and inverted bowl-like upper housing 246 abutting against the lower housing circular-cylindrically-shaped side wall 218 of the shallow and bowl-like lower housing 216, and with the upper housing bottom centrally-disposed throughbore 258 in the upper housing flat and ring-shaped bottom 254 of the shallow and inverted bowl-like upper housing 246 communicating with the lower housing top centrally disposed and circular-shaped throughbore 242 in the lower housing circular-shaped top 229 of the shallow and bowl-like lower housing 216.

The rotating display device 210 further includes a horizontally-oriented and circular-shaped rotating disk 266 that is contained in the shallow and inverted bowl-like upper housing 246 and has a rotating disk flat upper surface 247 on which an item can be rested and rotated when the shallow and inverted bowl-like upper housing 246 is removed from the shallow and bowl-like lower housing 216.

The horizontally-oriented and circular-shaped rotating disk 266 further has a rotating disk side wall 267 and a rotating disk flat lower surface 268 with a rotating disk lower surface circumferentially-disposed recess 270 that extends completely and circumferentially therearound, in proximity to the rotating disk side wall 267 of the large and circular-shaped rotating disk 266, in vertical alignment with the lower housing top inner peripheral ring upper surface circumferentially-disposed recess 244 in the lower housing top inner peripheral ring upper surface 243 of the lower housing top horizontally-oriented inner peripheral ring 238 of the lower housing circular-shaped top 229 of the shallow and bowl-like lower housing 216, and rotatively receiving the bearing 245, so that the horizontally-oriented and circular-shaped rotating disk 266 is rotatable relative to the shallow and inverted bowl-like upper housing 246.

The rotating display device 210 further includes a large and horizontally-oriented bottom hanger driven gear 272 that has a diameter less than that of the horizontally-oriented and circular-shaped rotating disk 266, is fixedly attached to for rotation with, and extends coaxially downwardly from, the rotating disk flat lower surface 268 of the horizontally-oriented and circular-shaped rotating disk 266, rotatively through the lower housing top centrally disposed and circular-shaped throughbore 242 in the lower housing circular-shaped top 229 of the shallow and bowl-like lower housing 216, into the shallow and bowl-like lower housing 216, and terminating in a bottom hanger driven gear lower surface 274 with a bottom hanger driven gear lower surface center 276.

The rotating display device 210 further includes a lower hanger assembly 278 that is fixedly attached to, and extends perpendicularly downwardly from the bottom hanger driven gear lower surface center 276 of the bottom hanger driven gear lower surface 274 of the large and horizontally-oriented bottom hanger driven gear 272, enters into the lower housing bottom throughbore perimeter hollow, upwardly-extending, and cylindrically-shaped collar 227 of the shallow and bowl-like lower housing 216, without leaving the lower housing flat, horizontally-oriented, and circular-shaped bottom 222 of the shallow and bowl-like lower housing 216.

The lower hanger assembly 278 has a lower hanger assembly lateral throughbore 280 that extends horizontally therethrough from which the planter 14 is suspended.

The rotating display device 210 further includes a motor 282 that is contained in the shallow and bowl-like lower housing 216 and rests on the lower housing flat, horizontally-oriented, and circular-shaped bottom 222 of the shallow and bowl-like lower housing 216.

The rotating display device 210 further includes a motor shaft 284 that is contained in the shallow and bowl-like lower housing 216, extends perpendicularly vertically upwardly from the motor 282, and terminates in a motor shaft distal end 286.

The rotating display device 210 further includes a small and horizontally-oriented motor driver gear 288 that is fixedly attached to the motor shaft distal end 286 of the motor shaft 284 rotates with the motor shaft 284, and is contained in the shallow and bowl-like lower housing 216, below, and parallel to, the lower housing top horizontally-oriented inner peripheral ring 238 of the lower housing circular-shaped top 229 of the shallow and bowl-like lower housing 216.

The small and horizontally-oriented motor driver gear 288 is smaller than, is collinear with, and rotatively engages, the large and horizontally-oriented bottom hanger driven gear 272.

The rotating display device 210 further includes a pair of battery holders 290 that are contained in the shallow and bowl-like lower housing 216 and rest on the lower housing flat, horizontally-oriented, and circular-shaped bottom 222 of the shallow and bowl-like lower housing 216, and hold batteries 292.

When the batteries 292 held in the pair of battery holders 290 power the motor 282 and rotate the motor shaft 284, the small and horizontally-oriented motor driver gear 288 rotates, which in turn rotates the large and horizontally-oriented bottom hanger driven gear 272, which in turn ultimately rotates both the bottom hanger assembly 278 and the horizontally-oriented and circular-shaped rotating disk 266.

The configuration of the second alternate embodiment of a rotating display device 310 can best be seen in FIGS. 11 and 12, which are a diagrammatic side elevational view of a second alternate embodiment of the present invention similar to that of the first alternate embodiment, except that the top and bottom hanger assemblies are pivotally mounted, and an enlarged diagrammatic cross sectional view with parts broken away taken generally in the direction of arrow 12 in FIG. 11 illustrating the top hanger assembly in the retracted position, respectively, and as such will be discussed with reference thereto.

The rotating display device 310 is similar to the rotating display device 210, except that the upper housing circular-shaped and upwardly tapering top 260 of the shallow and inverted bowl-like upper housing 246 is replaced by an upper housing flat and circular-shaped top 360 that has an upper housing top centrally-disposed and vertically-oriented recess 364 therein, the upper housing top centrally disposed and upwardly extending upper hanger assembly 262 is replaced by an upper housing top centrally disposed and pivotally-mounted upper hanger assembly 362 that is pivotally mounted in the upper housing top centrally-disposed and vertically-oriented recess 364 in the upper housing flat and circular-shaped top 360, and the lower hanger assembly 278 is replaced by a lower housing bottom centrally disposed and pivotally-mounted lower hanger assembly 366 that is pivotally mounted to the large and horizontally-oriented bottom hanger driven gear 272 and which extends downwardly past the lower housing flat, horizontally-oriented, and circular-shaped bottom 222 of the shallow and bowl-like lower housing 216.

The upper housing top centrally disposed and pivotally-mounted upper hanger assembly 362 includes an upper housing top upper hanger assembly pivot support 368 that extends vertically upwardly from, and is fixedly attached to, the upper housing top centrally-disposed and vertically-oriented recess 364 in the upper housing flat and circular-shaped top 360 without leaving the upper housing flat and circular-shaped top 360.

The upper housing top centrally disposed and pivotally-mounted upper hanger assembly 362 further includes an upper housing top upper hanger assembly D-ring 370 that is pivotally mounted to the upper housing top upper hanger assembly pivot support 368 of the upper housing top centrally disposed and pivotally-mounted upper hanger assembly 362.

When the upper housing top upper hanger assembly D-ring 370 of the upper housing top centrally disposed and pivotally-mounted upper hanger assembly 362 is pivoted downward relative to the upper housing top upper hanger assembly pivot support 368 of the upper housing top centrally disposed and pivotally-mounted upper hanger assembly 362, the upper housing top upper hanger assembly D-ring 370 of the upper housing top centrally disposed and pivotally-mounted upper hanger assembly 362 lies in the upper housing top centrally-disposed and vertically-oriented recess 364 in the upper housing flat and circular-shaped top 360 without leaving the upper housing flat and circular-shaped top 360, so that items can be rested on the upper housing flat and circular-shaped top 360.

Figure 15:
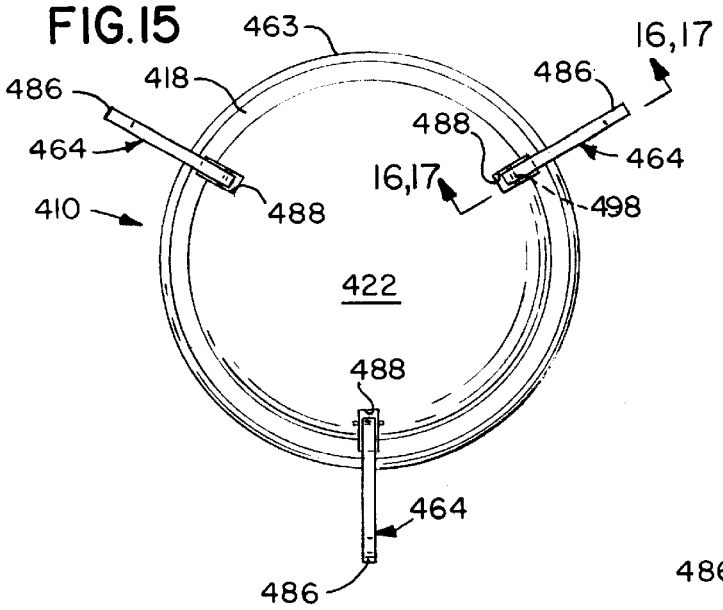
FIG. 15 is a bottom plan view taken generally in the direction of arrow 15 in FIG. 14.
Figure 17:
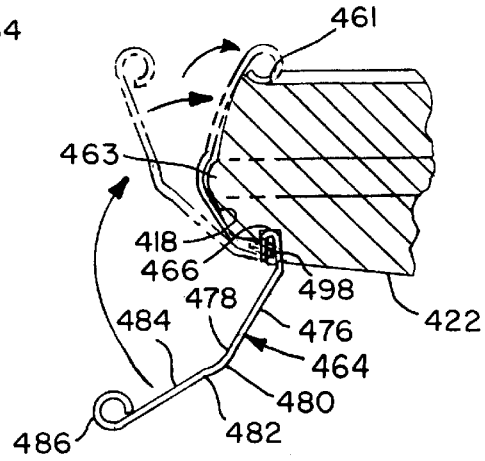
FIG. 17 is an enlarged cross sectional view with parts broken away taken on line 17—17 in FIG. 15 illustrating the clasps securing the bottom housing to the top housing.
Figure 16:
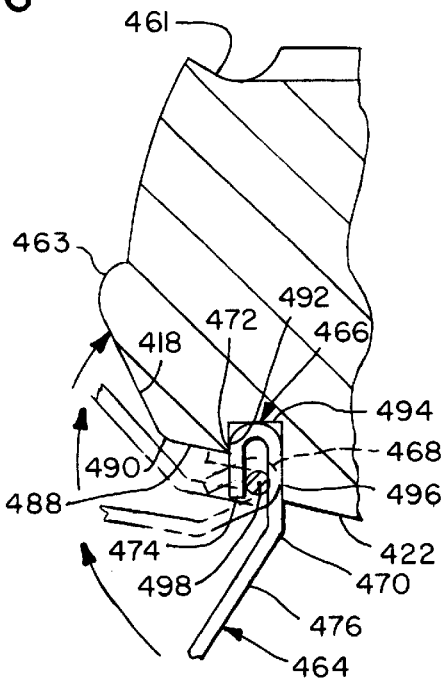
FIG. 16 is an enlarged cross sectional view with parts broken away taken on line 16—16 in FIG. 15 illustrating the interrelationship of the clasps and the bottom housing.

The configuration of the third alternate embodiment of a rotating display device 410 can best be seen in FIGS. 14–17, which are a diagrammatic side elevational view of a third alternate embodiment of the present invention with clasps utilized to hold the top housing to the bottom housing that are pivoted downwardly from the bottom housing and function as legs, a bottom plan view taken generally in the direction of arrow 15 in FIG. 14, an enlarged cross sectional view with parts broken away taken on line 16—16 in FIG. 15 illustrating the interrelationship of the clasps and the bottom housing, and an enlarged cross sectional view with parts broken away taken on line 17—17 in FIG. 15 illustrating the clasps securing the bottom housing to the top housing, respectively, and as such will be discussed with reference thereto.

The rotating display device 410 is similar to the rotating device 210, except that the lower housing circular-cylindrically-shaped side wall 218 of the shallow and bowl-like lower housing 216 is replaced by a lower housing circular-shaped and downwardly tapering side wall 418, the lower housing flat, horizontally-oriented, and circular-shaped bottom 222 of the shallow and bowl-like lower housing 216 is replaced by a lower housing circular-shaped and slightly downwardly tapering bottom 422, the lower hanger assembly 278 extends downwardly past the lower housing circular-shaped and slightly downwardly tapering bottom 422 of the shallow and bowl-like lower housing 216, the upper housing circular-shaped and upwardly tapering side wall 248 of the shallow and inverted bowl-like upper housing 246 has a lower edge with an upper housing side wall lower edge circumferentially-disposed lip 463 that extends radially outwardly therearound, and the upper housing circular-shaped and upwardly tapering top 260 of the shallow and inverted bowl-like upper housing 246 has an upper housing top circumferentially-disposed recess 461 that extends completely and circumferentially therearound and in close proximity to the upper housing side wall upper edge 252 of the shallow and inverted bowl-like upper housing 246.

Since the lower housing circular-shaped and slightly downwardly tapering bottom 422 of the shallow and bowl-like lower housing 216 is not flat, means must be provided to elevate the rotating display device 410 above the surface it is to rest upon.

Such a means is provided by three pivotally-mounted and springy legs 464 that are pivotally mounted to the shallow and bowl-like lower housing 216 and have an extended position where they elevate the rotating display device 410 above the surface it is to rest upon and allow the shallow and inverted bowl-like upper housing 246 to be removed from the shallow and bowl-like lower housing 216 and expose the horizontally-oriented and circular-shaped rotating disk 266 so as to allow an item to be rotatively supported thereon, and a retracted position where they replaceably maintain the shallow and inverted bowl-like upper housing 246 onto the shallow and bowl-like lower housing 216.

In the extended position, each leg of the three pivotally-mounted and springy legs 464 has a leg slender and inverted U-shaped mounting portion 466 with a length, a leg mounting portion slender innermost leg 468 that terminates in a leg mounting portion innermost leg end 470, and a leg mounting portion slender outermost leg 472 that terminates in a leg mounting portion outermost leg end 474.

In the extended position, each leg of the three pivotally-mounted and springy legs 464 further has a leg slender, elongated, and outwardly diverging upper portion 476 that is integral with, and extends downwardly and outwardly from, the leg mounting portion innermost leg end 470 of the leg mounting portion slender innermost leg 468 of the leg slender and inverted U-shaped mounting portion 466 thereof, is coplanar with the leg mounting portion slender innermost leg 468 of the leg slender and inverted U-shaped mounting portion 466 thereof, and terminates in a leg upper portion end 478.

In the extended position, each leg of the three pivotally-mounted and springy legs 464 further has a leg slender and concavo-convex-shaped intermediate portion 480 that is integral with, and extends downwardly and outwardly from, the leg upper portion end 478 of the leg slender, elongated, and outwardly diverging upper portion 476 thereof, is coplanar with the leg slender, elongated, and outwardly diverging upper portion 476, and terminates in a leg intermediate portion end 482.

In the extended position, each leg of the three pivotally-mounted and springy legs 464 further has a leg slender, elongated, and outwardly diverging lower portion 484 that is integral with, and extends downwardly and outwardly from, the leg intermediate portion end 482 of the leg slender and concavo-convex-shaped intermediate portion 480 thereof, is coplanar with the leg slender and concavo-convex-shaped intermediate portion 480 thereof, and terminates in a leg lower portion outwardly-extending ring 486 that is coplanar with the leg slender, elongated, and outwardly diverging lower portion 484 thereof.

The shallow and bowl-like lower housing 216 further has a lower housing three equally spaced-apart, specifically-configured, and radially-oriented recesses 488.

Each recess of the lower housing three equally spaced-apart, specifically-configured, and radially-oriented recesses 488 in the shallow and bowl-like lower housing 216 open into both the lower housing circular-shaped and downwardly tapering side wall 418 of the shallow and bowl-like lower housing 216 and the lower housing circular-shaped and slightly downwardly tapering bottom 422 of the shallow and bowl-like lower housing 216.

Each recess of the lower housing three equally spaced-apart, specifically-configured, and radially-oriented recesses 488 in the shallow and bowl-like lower housing 216 is defined by a recess flat and inwardly-slightly-downwardly-extending outer upper wall 490 that extends inwardly and slightly downwardly from the lower housing circular-shaped and downwardly tapering side wall 418 of the shallow and bowl-like lower housing 216 to an elevation above the lower housing circular-shaped and slightly downwardly tapering bottom 422 of the shallow and bowl-like lower housing 216.

Each recess of the lower housing three equally spaced-apart, specifically-configured, and radially-oriented recesses 488 in the shallow and bowl-like lower housing 216 is further defined by a recess flat and vertically-oriented outer side wall 492 that extends vertically upwardly from the recess flat and inwardly-slightly-downwardly-extending outer upper wall 490 thereof, to a height less than that of the leg slender and inverted U-shaped mounting portion 466.

Each recess of the lower housing three equally spaced-apart, specifically-configured, and radially-oriented recesses 488 in the shallow and bowl-like lower housing 216 is further defined by a recess flat and horizontally-oriented inner upper wall 494 that perpendicularly inwardly from the recess flat and vertically-oriented outer side wall 492 thereof, is above the recess flat and inwardly-slightly-downwardly-extending outer upper wall 490 thereof, and has a length equal to the width of the leg slender and inverted U-shaped mounting portion 466.

Each recess of the lower housing three equally spaced-apart, specifically-configured, and radially-oriented recesses 488 in the shallow and bowl-like lower housing 216 is further defined by a recess flat and vertically-oriented inner side wall 496 that extends perpendicularly downwardly from the recess flat and horizontally-oriented inner upper wall 494 thereof to the lower housing circular-shaped and slightly downwardly tapering bottom 422 of the shallow and bowl-like lower housing 216, and is parallel to, longer than, and inward of, the recess flat and vertically-oriented outer side wall 492 thereof.

Each recess of the lower housing three equally spaced-apart, specifically-configured, and radially-oriented recesses 488 in the shallow and bowl-like lower housing 216 has a recess horizontally-oriented pivot pin 498 that extends fixedly thereacross, between the recess flat and vertically-oriented outer side wall 492 thereof and the recess flat and vertically-oriented inner side wall 496 thereof, below the recess flat and inwardly-slightly-downwardly-extending outer upper wall 490 thereof, and slightly above the lower housing circular-shaped and slightly downwardly tapering bottom 422 of the shallow and bowl-like lower housing 216.

Each leg of the three pivotally-mounted and springy legs 464 is pivotally mounted in a respective recess of the lower housing three equally spaced-apart, specifically-configured, and radially-oriented recesses 488 in the shallow and bowl-like lower housing 216, by a respective horizontally-oriented pivot pin 498 passing through the leg slender and inverted U-shaped mounting portion 466 thereof.

In the extended position and with the rotating display device 410 resting on a surface, the weight of the rotating display device 410 causes each leg slender and inverted U-shaped mounting portion 466 of the three pivotally-mounted and springy legs 464 to ride up, and be captured in, the respective recess of the three equally spaced-apart and specifically-configured recesses 488 in the shallow and bowl-like lower housing 216, with the leg mounting portion slender innermost leg 468 thereof abutting against the recess flat and vertically-oriented inner side wall 496 of the respective recess of the three equally spaced-apart and specifically-configured recesses 488 in the shallow and bowl-like lower housing 216, and with the leg mounting portion slender outermost leg 472 thereof abutting against the recess flat and vertically-oriented outer side wall 492 of the respective recess of the three equally spaced-apart and specifically-configured recesses 488 in the shallow and bowl-like lower housing 216, so that the three pivotally-mounted and springy legs 464 can not pivot relative to the horizontally-oriented pivot pin 498 in each of the three equally spaced-apart and specifically-configured recesses 488 in the shallow and bowl-like lower housing 216 and thereby provide a support for elevating the rotating display device 410 on the surface while allowing the shallow and inverted bowl-like upper housing 246 to be removed and expose the horizontally-oriented and circular-shaped rotating disk 266 for rotatively supporting the item thereon.

The method for retracting the three pivotally-mounted and springy legs 464 so as to maintain the shallow and inverted bowl-like upper housing 246 onto the shallow and bowl-like lower housing 216 will be discussed, infra.

Step 1: Lift the rotating display device 410 off the surface.

Step 2: Cause by gravity the leg slender and inverted U-shaped mounting portion 466 of each of the three pivotally-mounted and springy legs 464 to slide down the recess horizontally-oriented pivot pin 498 in the respective recess of the lower housing three equally spaced-apart, specifically-configured, and radially-oriented recesses 488 in the shallow and bowl-like lower housing 216.

Step 3: Cause simultaneously by gravity the leg mounting portion slender outermost leg 472 of the leg slender and inverted U-shaped mounting portion 466 of each of the three pivotally-mounted and springy legs 464 to slide down, and leave, the recess flat and vertically-oriented outer side wall 492 of the respective recess of the lower housing three equally spaced-apart, specifically-configured, and radially-oriented recesses 488 in the shallow and bowl-like lower housing 216.

Step 4: Cause simultaneously by gravity the leg mounting portion slender innermost leg 468 of the leg slender and inverted U-shaped mounting portion 466 of each of the three pivotally-mounted and springy legs 464 to slide down, and leave, the recess flat and vertically-oriented inner side wall 496 of the respective recess of the lower housing three equally spaced-apart, specifically-configured, and radially-oriented recesses 488 in the shallow and bowl-like lower housing 216, so that each of the three pivotally-mounted and springy legs 464 can pivot relative to the horizontally-oriented pivot pin 498 in the respective recess of the lower housing three equally spaced-apart, specifically-configured, and radially-oriented recesses 488 in the shallow and bowl-like lower housing 216.

Step 5: Pivot each of the three pivotally-mounted and springy legs 464 upwardly and outwardly.

Step 6: Abut the leg mounting portion slender outermost leg 472 of each leg of the three pivotally-mounted and springy legs 464 against the recess flat and inwardly-slightly-downwardly-extending outer upper wall 490 of the respective recess of the lower housing three equally spaced-apart, specifically-configured, and radially-oriented recesses 488 in the shallow and bowl-like lower housing 216.

Step 6: Abut the leg slender, elongated, and outwardly diverging upper portion 476 of each leg of the three pivotally-mounted and springy legs 464 against, while substantially conforming to, the lower housing circular-shaped and downwardly tapering side wall 418 of the shallow and bowl-like lower housing 216.

Step 7: Abut the leg slender and concavo-convex-shaped intermediate portion 480 of each leg of the three pivotally-mounted and springy legs 464 against, while substantially conforming to, the upper housing side wall lower edge circumferentially-disposed lip 463 of the upper housing circular-shaped and upwardly tapering side wall 248 of the shallow and inverted bowl-like upper housing 246.

Step 8: Abut the leg slender, elongated, and outwardly diverging lower portion 484 of each leg of the three pivotally-mounted and springy legs 464 against, while substantially conforming to, the upper housing circular-shaped and upwardly tapering side wall 248 of the shallow and inverted bowl-like upper housing 246.

Step 9. Entrap the leg lower portion outwardly-extending ring 486 of each leg of the three pivotally-mounted and springy legs 464 in the upper housing top circumferentially-disposed recess 461 in the upper housing circular-shaped and upwardly tapering top 260 of the shallow and inverted bowl-like upper housing 246, so that the shallow and inverted bowl-like upper housing 246 is replaceably maintained to the shallow and bowl-like lower housing 216.

The method for extending the three pivotally-mounted and springy legs 464 so as to elevate the rotating display device 410 above the surface it is to rest upon and allow the shallow and inverted bowl-like upper housing 246 to be removed from the shallow and bowl-like lower housing 216 and expose the horizontally-oriented and circular-shaped rotating disk 266 so as to allow an item to be rotatively supported thereon will be discussed, infra.

Step 1: Remove the leg lower portion outwardly-extending ring 486 of each leg of the three pivotally-mounted and springy legs 464 from the upper housing top circumferentially-disposed recess 461 in the upper housing circular-shaped and upwardly tapering top 260 of the shallow and inverted bowl-like upper housing 246.

Step 2: Pivot each of the three pivotally-mounted and springy legs 464 outwardly and downwardly.

Step 3: Remove simultaneously by gravity the leg slender, elongated, and outwardly diverging lower portion 484 of each leg of the three pivotally-mounted and springy legs 464 from the upper housing circular-shaped and upwardly tapering side wall 248 of the shallow and inverted bowl-like upper housing 246.

Step 4: Remove simultaneously by gravity the leg slender and concavo-convex-shaped intermediate portion 480 of each leg of the three pivotally-mounted and springy legs 464 from the upper housing side wall lower edge circumferentially-disposed lip 463 of the upper housing circular-shaped and upwardly tapering side wall 248 of the shallow and inverted bowl-like upper housing 246.

Step 5: Remove simultaneously by gravity the leg slender, elongated, and outwardly diverging upper portion 476 of each leg of the three pivotally-mounted and springy legs 464 from the lower housing circular-shaped and downwardly tapering side wall 418 of the shallow and bowl-like lower housing 216.

Step 6: Remove simultaneously by gravity the leg mounting portion slender outermost leg 472 of each leg of the three pivotally-mounted and springy legs 464 from the recess flat and inwardly-slightly-downwardly-extending outer upper wall 490 of the respective recess of the lower housing three equally spaced-apart, specifically-configured, and radially-oriented recesses 488 in the shallow and bowl-like lower housing 216.

Step 7: Lift the rotating display device 410.

Step 8: Push each leg of the three pivotally-mounted and springy legs 464 upwardly.

Step 9: Slide the leg slender and inverted U-shaped mounting portion 466 of the respective leg of the three pivotally-mounted and springy legs 464 up the recess horizontally-oriented pivot pin 498 in the respective recess of the lower housing three equally spaced-apart, specifically-configured, and radially-oriented recesses 488 in the shallow and bowl-like lower housing 216 and into the respective recess of the lower housing three equally spaced-apart, specifically-configured, and radially-oriented recesses 488 in the shallow and bowl-like lower housing 216.

Step 10: Cause simultaneously the leg mounting portion slender outermost leg 472 of the leg slender and inverted U-shaped mounting portion 466 of each leg of the three pivotally-mounted and springy legs 464 to slide up, and abut against, the recess flat and vertically-oriented outer side wall 492 of the respective recess of the lower housing three equally spaced-apart, specifically-configured, and radially-oriented recesses 488 in the shallow and bowl-like lower housing 216.

Step 11: Cause simultaneously the leg mounting portion slender innermost leg 468 of the leg slender and inverted U-shaped mounting portion 466 of each leg of the three pivotally-mounted and springy legs 464 to slide up, and abut against, the recess flat and vertically-oriented inner side wall 496 of the respective recess of the lower housing three equally spaced-apart, specifically-configured, and radially-oriented recesses 488 in the shallow and bowl-like lower housing 216 so as to prevent each leg of the three pivotally-mounted and springy legs 464 from pivoting relative to the horizontally-oriented pivot pin 498 in the respective recess of the lower housing three equally spaced-apart, specifically-configured, and radially-oriented recesses 488 in the shallow and bowl-like lower housing 216, so that the three pivotally-mounted and springy legs 464 extend non-pivotally downwardly from the shallow and bowl-like lower housing 216 and elevate the rotating display device 410 above the surface it rests upon and allow the shallow and inverted bowl-like upper housing 246 to be removed from the shallow and bowl-like lower housing 216 and expose the horizontally-oriented and circular-shaped rotating disk 266 so as to allow the item to be rotatively supported thereon.

It is apparent that the configurations of the lower housing three equally spaced-apart, specifically-configured, and radially-oriented recesses 488 in the shallow and bowl-like lower housing 216 and the three pivotally-mounted and springy legs 464 of the present invention are not merely a matter of design choice but are significant and of critical importance. They therefore must be considered in determining patentability, as was decided in In re *Dailey* et al., 149 USPQ 47 (CCPA 1976), where the Court held that the shape of a device must be considered in determining patentability, if the shape is significant:

" . . . the configuration of the container is a 'mere matter of choice' not significantly novel . . . , [since] . . . Appellants have provided no argument which convinces us that the particular configuration of their container is significant . . . " [Emphasis added]

Figure 18:
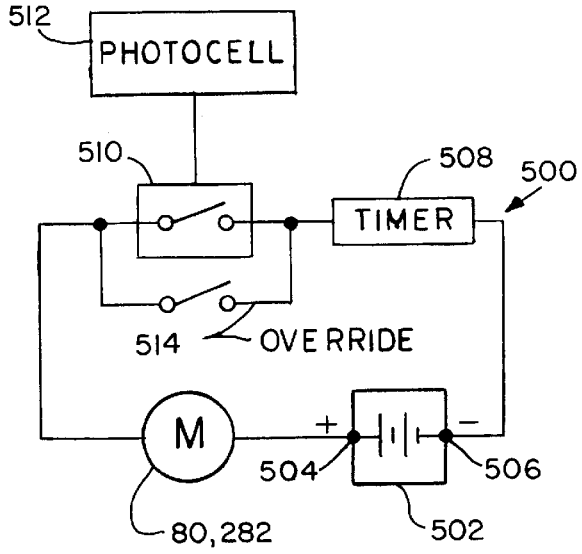
FIG. 18 is a block diagram of the power circuit.

The rotating display device 10, 210, 310, 410 is powered by a power circuit 500 whose configuration is best seen in FIG. 18, which is a block diagram of the power circuit, and as such will be discussed with reference thereto.

The power circuit 500 includes a power circuit power supply 502, such as batteries, voltaic photocells, or the like that has a power circuit power supply positive terminal 504 and a power circuit power supply negative terminal 506.

The power circuit 500 further includes a power circuit timer 508 that is connected in series to the power circuit power supply negative terminal 506 of the power circuit power supply 502 of the power circuit 500.

The power circuit 500 further includes the motor 80, 282 connected in series to the power circuit power supply positive terminal 504 of the power circuit power supply 502 of the power circuit 500.

The power circuit 500 further includes a power circuit photocell gate 510 that is connected in series to, and between, the power circuit timer 508 of the power circuit 500 and the motor 80, 282 of the power circuit 500.

The power circuit 500 further includes a power circuit photocell 512 that is connected in series to, and operated by, the power circuit photocell gate 510 of the power circuit 500.

The power circuit 500 further includes a power circuit timer override switch 514 that is connected in parallel to the power circuit photocell gate 510 of the power circuit 500.

It will be understood that each of the elements described above, or two or more together, may also find a useful application in other types of constructions differing from the types described above.

While the invention has been illustrated and described as embodied in a rotating display device is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

What is claimed is:

1. A rotatable display device suspendable from a ceiling and allowing a planter to be rotatably suspendable therefrom, comprising:

a) a shallow and bowl-like lower housing;

b) a shallow and inverted bowl-like upper housing replaceably attached to said shallow and bowl-like lower housing;

c) a top hanger assembly extending upwardly from said shallow and inverted bowl-like upper housing for suspending said rotatable display device from the ceiling and providing a means for grabbing said shallow and inverted bowl-like upper housing when said shallow and inverted bowl-like upper housing is to be removed from said shallow and bowl-like lower housing;

d) a rotatable plate contained in, and rotatable relative to, one of said shallow and bowl-like lower housing and said shallow and inverted bowl-like upper housing:

e) a bearing assembly rotatable connecting said rotatable plate to other of said one of said shallow and bowl-like lower housing and said shallow and inverted bowl-like upper housing;

f) a large and horizontally-oriented driven gear fixedly attached to, for rotation with, said rotatable plate;

g) a bottom hanger assembly extending downwardly from, and rotating with, one of said rotatable plate and said large and horizontally-oriented driven gear for rotatable suspending the Planter therefrom;

h) a motor contained in said other of said one of said shallow and bowl-like lower housing and said shallow and inverted bowl-like upper housing for rotating said rotatable plate;

i) a motor shaft extending from said motor; and j) a small and horizontally-oriented motor driver gear fixedly attached to said motor shaft for rotation therewith and being contained in said shallow and bowl-like lower housing; said small and horizontally-oriented motor driver gear being smaller than, and rotatably operatively connected to, said large and horizontally-oriented driven gear, so that when said motor shaft rotates, said small and horizontally-oriented motor driver gear rotates, which in turn rotates said large and horizontally-oriented driven gear, which in turn rotates said rotatable plate and said bottom hanger assembly which is suspended from said one of said rotatable plate and said large and horizontally-oriented driven gear, and which in turn rotates the planter suspendable therefrom, wherein said shallow and bowl-like lower housing has a circular-shaped and downwardly tapering side wall, wherein said shallow and bowl-like lower housing further has a circular-shaped and slightly downwardly tapering bottom that extends downwardly from, and is integral with, said lower edge of said circular-shaped and downwardly-tapering side wall of said shallow and bowl-like lower housing, wherein said circular-shaped and downwardly-tapering bottom of said shallow and bowl-like lower housing has a centrally-disposed throughbore that is defined by a radially-inwardly tapering perimeter with an outwardly diverging upper edge and an outwardly diverging lower edge, wherein said shallow and bowl-like lower housing further has an open top defined by said upper edge of said circular-shaped and downwardly-tapering side wall of said shallow and bowl-like lower housing, wherein said rotatable plate is a shallow dish-like rotatable plate contained in said shallow and bowl-like lower housing and has a circular-shaped and downwardly tapering side wall that is inward of, and in close proximity to, said circular-shaped and downwardly tapering side wall of said shallow and bowl-like lower housing and has a lower edge.

2. The device as defined in claim 1, wherein said shallow dish-like rotatable plate further has a flat and circular-shaped bottom that extends across, and is integral with, said lower edge of said circular-shaped and downwardly tapering side wall of said shallow dish-like rotatable plate, and is spaced above said circular-shaped and slightly downwardly tapering bottom of said shallow and bowl-like lower housing.

3. The device as defined in claim 2, wherein said flat and circular-shaped bottom of said shallow dish-like rotatable plate has a circular-shaped perimeter, a flat upper surface, a flat lower surface, and a center that is in vertical alignment with said centrally disposed throughbore in said circular-shaped and slightly downwardly tapering bottom of said shallow and bowl-like lower housing.

4. The device as defined in claim 3, wherein said bearing assembly is a circular-shaped thrust bearing assembly that has a circular-shaped lower race disposed on said flat upper surface of said flat and circular-shaped bottom of said shallow dish-like rotatable plate, at said circular-shaped perimeter of said flat and circular-shaped bottom of said shallow dish-like rotatable plate, and a circular-shaped upper race.

5. The device as defined in claim 4, wherein said large and horizontally-oriented driven gear is fixedly attached to said flat upper surface of said flat and circular-shaped bottom of said shallow dish-like rotatable plate, at said center of said flat and circular-shaped bottom of said shallow dish-like rotatable plate, and has a center, and is contained in said shallow and bowl-like lower housing.

6. The device as defined in claim 5; further comprising a slender, elongated, vertically-oriented, and cylindrically-shaped shaft fixedly attached to, and extending perpendicularly vertically upwardly from, said center of said large and horizontally-oriented driven gear, and rotates with said large and horizontally-oriented driven gear.

7. The device as defined in claim 6, wherein said bottom hanger assembly is replaceably securable to said circular-shaped and slightly downwardly tapering bottom of said shallow and bowl-like lower housing, selectively enters and leaves said centrally disposed throughbore in said circular-shaped and slightly downwardly tapering bottom of said shallow and bowl-like lower housing, and has an extended position relative to said circular-shaped and slightly downwardly tapering bottom where the planter is suspended a maximal distance therebelow and a retracted position relative to said circular-shaped and slightly downwardly tapering bottom where the planter is suspended a minimal distance therebelow.

8. The device as defined in claim 7, wherein said bottom hanger assembly is suspended from said flat lower surface of said flat and circular-shaped bottom of said shallow dish-like rotatable plate, at said center of said flat and circular-shaped bottom of said shallow dish-like rotatable plate, by a cord that passes vertically and freely through said centrally disposed throughbore in said circular-shaped and slightly downwardly tapering bottom of said shallow and bowl-like lower housing, and rotates with said shallow dish-like rotatable plate.

9. The device as defined in claim 8; further comprising a cylindrically-shaped cord housing fixedly attached to said flat lower surface of said flat and circular-shaped bottom of said shallow dish-like rotatable plate, at said center of said flat and circular-shaped bottom of said shallow dish-like rotatable plate, and rotating with said shallow dish-like rotatable plate.

10. The device as defined in claim 9, wherein said cylindrically-shaped cord housing houses said cord and a spiral retraction spring that is operatively connected to said cord for retracting said cord into said cylindrically-shaped cord housing when the planter is removed from said bottom hanger assembly.

11. The device as defined in claim 10, wherein said shallow and inverted bowl-like upper housing has a circular-shaped and upwardly tapering side wall with a lower edge that has a circumferentially-disposed lip that extends outwardly therearound, and an upper edge.

12. The device as defined in claim 11, wherein said shallow and inverted bowl-like upper housing further has a flat and circular-shaped bottom that extends across said lower edge of said circular-shaped and upwardly tapering side wall of said shallow and inverted bowl-like upper housing and has a centrally disposed throughbore that extends vertically therethrough and an upper surface.

13. The device as defined in claim 12, wherein said shallow and inverted bowl-like upper housing further has a circular-shaped and upwardly tapering top that extends across said upper edge of said circular-shaped and upwardly tapering side wall of said shallow and inverted bowl-like upper housing and has a centrally disposed collar that extends vertically downwardly inwardly thereform and which is vertically aligned with said centrally disposed throughbore in said upper housing flat and circular-shaped bottom of said shallow and inverted bowl-like upper housing.

14. The device as defined in claim 13, wherein said shallow and inverted bowl-like upper housing is replaceably attached to said shallow and bowl-like lower housing, with said lower edge of said circular-shaped and upwardly tapering side wall of said shallow and inverted bowl-like upper housing abutting against said upper edge of said circular-shaped and downwardly tapering side wall of said shallow and bowl-like lower housing, with said flat and circular-shaped bottom of said shallow and inverted bowl-like upper housing abutting against said circular-shaped upper race of said circular-shaped thrust bearing assembly, and with said slender, elongated, vertically-oriented, and cylindrically-shaped shaft extending vertically upwardly and rotatively through said centrally disposed throughbore in said flat and circular-shaped bottom of said shallow and inverted bowl-like upper housing and rotatively into said centrally disposed collar of said circular-shaped and upwardly tapering top of said shallow and inverted bowl-like upper housing, so that said shallow dish-like rotatable plate is rotatable relative to said shallow and bowl-like lower housing.

15. The device as defined in claim 14, wherein said top hanger assembly has a thin and circular-shaped disk disposed on said circular-shaped and upwardly tapering top of said shallow and inverted bowl-like upper housing, opposite to said centrally disposed collar of said circular-shaped and upwardly tapering top of said shallow and inverted bowl-like upper housing.

16. The device as defined in claim 15, wherein said top hanger assembly further has a ring for suspending said rotatable display device from the ceiling and which extends vertically upwardly from said thin and circular-shaped disk of said top hanger assembly.

17. The device as defined in claim 16, wherein said motor is contained in said shallow and inverted bowl-like upper housing and is disposed on said upper surface of said upper flat and circular-shaped bottom of said shallow and inverted bowl-like upper housing, in close proximity to said lower edge of said circular-shaped and upwardly tapering side wall of said shallow inverted bowl-like upper housing.

18. The device as defined in claim 17; further comprising a pair of parallel, spaced-apart, and rectangular-parallelepiped-shaped battery holders contained in said shallow and inverted bowl-like upper housing, on said upper surface of said flat and circular-shaped bottom of said shallow and inverted bowl-like upper housing, and straddling said slender, elongated, vertically-oriented, and cylindrically-shaped shaft.

19. The device as defined in claim 18, wherein each holder of said pair of parallel, spaced-apart, and rectangular-parallelepiped-shaped battery holders is formed by a pair of parallel, spaced-apart, and rectangular-parallelepiped-shaped walls that extend perpendicularly vertically upwardly from, and along chords of, said upper surface of said flat and circular-shaped bottom of said shallow and inverted bowl-like upper housing.

20. The device as defined in claim 19, wherein an outermost wall of one pair of parallel, spaced-apart, and rectangular-parallelepiped-shaped walls of one holder of said pair of parallel, spaced-apart, and rectangular-parallelepiped-shaped battery holders together with said circular-shaped and upwardly tapering side wall of said shallow and inverted bowl-like upper housing define a space in which said motor is mounted.

21. The device as defined in claim 20, wherein each innermost wall of said pair of parallel, spaced-apart, and rectangular-parallelepiped-shaped walls of said pair of parallel, spaced-apart, and rectangular-parallelepiped-shaped battery holders straddle said centrally disposed throughbore in said flat and circular-shaped bottom of said shallow and inverted bowl-like upper housing, in close proximity thereto.

22. The device as defined in claim 21, wherein said motor shaft extends perpendicularly vertically downwardly from said motor, rotatively through a motor shaft throughbore in said flat and circular-shaped bottom of said shallow and inverted bowl-like upper housing, and into said shallow and bowl-like lower housing where it terminates in a distal end.

23. The device as defined in claim 22, wherein said small and horizontally-oriented motor driver gear is fixedly attached to said distal end of said motor shaft, and is contained in said shallow and bowl-like lower housing above, and parallel to, said large and horizontally-oriented driven gear.

24. The device as defined in claim 23; further comprising a vertically oriented idler gear shaft extending perpendicularly vertically downwardly and rotatively from said flat and circular-shaped bottom of said shallow and inverted bowl-like upper housing to said flat upper surface of said flat and circular-shaped bottom of said shallow dish-like rotatable plate, and is disposed on a radius from said motor shaft to said slender, elongated, vertically-oriented, and cylindrically-shaped shaft.

25. The device as defined in claim 24; further comprising a large and horizontally-oriented idler gear fixedly attached to, for rotation with, said vertically oriented idler gear shaft and being coplanar with, and rotatively engaging, said small and horizontally-oriented motor driver gear; said large and horizontally-oriented idler gear being identical to said large and horizontally-oriented driven gear and being contained in said shallow and bowl-like lower housing.

26. The device as defined in claim 25; further comprising a small and horizontally-oriented idler gear fixedly attached to, for rotation with, said vertically oriented idler gear shaft and being below, and parallel to, said large and horizontally-oriented idler gear; said small and horizontally-oriented idler gear being coplanar with, and rotatively engaging, said large and horizontally-oriented driven gear, and being contained in said shallow and bowl-like lower housing, so that when said motor shaft rotates, said small and horizontally-oriented motor driver gear rotates, which in turn rotates said large and horizontally-oriented idler gear, which in turn rotates said vertically oriented idler gear shaft, which in turn rotates said small and horizontally-oriented idler gear, which in turn rotates said large and horizontally-oriented driven gear, which in turn rotates said shallow dish-like rotatable plate, which in turn rotates said bottom hanger assembly, and which in turn rotates the planter suspendable therefrom.

27. The device as defined in claim 26, wherein said bottom hanger assembly includes a thin and circular-shaped disk that selectively opens and closes said centrally disposed throughbore in said circular-shaped and slightly downwardly tapering bottom of said shallow and bowl-like lower housing, while being rotative therein; said thin and circular-shaped disk of said bottom hanger assembly has an upper surface with a center to which said cord is attached, a lower surface, and a circular-shaped periphery.

28. The device as defined in claim 27, wherein said hanger assembly further includes an upper pair of diametrically-opposed and radially-outwardly-extending tabs that extend radially outwardly from said upper surface of said thin and circular-shaped disk of said bottom hanger assembly, at said circular-shaped periphery of said thin and circular-shaped disk of said bottom hanger assembly, and selectively engage with, and disengage from, said outwardly diverging upper edge of said radially-inwardly tapering perimeter of said centrally disposed throughbore in said circular-shaped and slightly downwardly tapering bottom of said shallow and bowl-like lower housing.

29. The device as defined in claim 28, wherein said bottom hanger assembly further includes a lower pair of diametrically-opposed and radially-outwardly-extending tabs that extend radially outwardly from said lower surface of said thin and circular-shaped disk of said bottom hanger assembly, at said circular-shaped periphery of said thin and circular-shaped disk of said bottom hanger assembly, and selectively engage with, and disengage from, said outwardly diverging lower edge of said radially-inwardly tapering perimeter of said centrally disposed throughbore in said circular-shaped and slightly downwardly tapering bottom of said shallow and bowl-like lower housing; said lower pair of diametrically-opposed and radially-outwardly-extending tabs of said bottom hanger assembly is disposed intermediate said upper pair of diametrically-opposed and radially-outwardly-extending tabs of said bottom hanger assembly.

30. The device as defined in claim 29, wherein said bottom hanger assembly further includes a ring that extends perpendicularly vertically downwardly from said lower surface of said thin and circular-shaped disk of said bottom hanger assembly and from which the planter is suspendable.

31. The device as defined in claim 30, wherein said bottom hanger assembly further includes said radially-inwardly tapering perimeter of said centrally disposed throughbore in said circular-shaped and slightly downwardly tapering bottom of said shallow and bowl-like lower housing having a pair of diametrically-opposed and radially-outwardly-extending throughslots that open into said centrally disposed throughbore in said circular-shaped and slightly downwardly tapering bottom of said shallow and bowl-like lower housing and have a configuration similar to that of said upper pair of diametrically-opposed and radially-outwardly-extending tabs of said mounted bottom hanger assembly so as to be able to selectively enter therein and leave therefrom.

32. The device as defined in claim 31, wherein said bottom hanger assembly further includes a pair of vertically-oriented and diametrically opposed stop pins that extend vertically upwardly from said outwardly diverging upper edge of said radially-inwardly tapering perimeter of said centrally disposed throughbore in said circular-shaped and slightly downwardly tapering bottom of said shallow and bowl-like lower housing, intermediate said lower pair of diametrically-opposed and radially-outwardly-extending throughslots in said radially-inwardly tapering perimeter of said centrally disposed throughbore in said circular-shaped and slightly downwardly tapering bottom of said shallow and bowl-like lower housing, and function as stops for rotation of said ring of said bottom hanger assembly by being abuttable by said upper pair of diametrically-opposed and radially-outwardly-extending tabs of said bottom hanger assembly.

33. The device as defined in claim 1 further comprising a power circuit selectively powering said motor.

34. The device as defined in claim 33, wherein said power circuit includes a power supply that has a positive terminal and a negative terminal and which is one of batteries and voltaic photocells.

35. The device as defined in claim 34, wherein said power circuit further includes a timer that is connected in series to said negative terminal of said power supply of said power circuit.

36. The device as defined in claim 35, wherein said motor is connected in series to said positive terminal of said power supply of said power circuit.

37. The device as defined in claim 36, wherein said power circuit further includes a photocell gate that is connected in series to, and between, said timer of said power circuit and said motor.

38. The device as defined in claim 37, wherein said power circuit further includes a photocell that is connected in series to, and operated by, said photocell gate of said power circuit.

39. The device as defined in claim 38, wherein said power circuit further includes a timer override switch that is connected in parallel to said photocell gate of said power circuit.

* * * * *